US010866544B2

(12) United States Patent
Midorikawa

(10) Patent No.: US 10,866,544 B2
(45) Date of Patent: Dec. 15, 2020

(54) COOLING DEVICE CONFIGURED TO COOL A SHEET AND A SHEET CONVEYING ROLLER, AND IMAGE FORMING APPARATUS INCORPORATING THE COOLING DEVICE

(71) Applicant: Ruki Midorikawa, Kanagawa (JP)

(72) Inventor: Ruki Midorikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/715,377

(22) Filed: Dec. 16, 2019

(65) Prior Publication Data

US 2020/0218181 A1 Jul. 9, 2020

(30) Foreign Application Priority Data

Jan. 8, 2019 (JP) ..... 2019-001057

(51) Int. Cl.
*G03G 15/00* (2006.01)
*G03G 15/20* (2006.01)
*G03G 21/20* (2006.01)

(52) U.S. Cl.
CPC ..... *G03G 15/2021* (2013.01); *G03G 21/206* (2013.01)

(58) Field of Classification Search
CPC ..... G03G 15/2017; G03G 15/2021; G03G 15/6573; G03G 21/206
USPC ..... 399/92, 341
See application file for complete search history.

(56) References Cited

U.S. PATENT DOCUMENTS

| | | | | |
|---|---|---|---|---|
| 7,890,014 | B2 * | 2/2011 | Koshida | G03G 15/6573 399/92 |
| 8,521,076 | B2 * | 8/2013 | Masuda | G03G 15/6573 399/341 |
| 8,811,840 | B2 * | 8/2014 | Suzuki | G03G 15/6573 399/341 |
| 8,903,265 | B2 * | 12/2014 | Kubo | G03G 21/206 399/92 |
| 10,534,315 | B2 * | 1/2020 | Midorikawa | G03G 21/206 |
| 2017/0235264 | A1 | 8/2017 | Midorikawa et al. | |
| 2019/0248609 | A1 | 8/2019 | Midorikawa | |
| 2019/0302690 | A1 | 10/2019 | Midorikawa | |

FOREIGN PATENT DOCUMENTS

| | | |
|---|---|---|
| JP | 2009-102111 | 5/2009 |
| JP | 2010-215311 | 9/2010 |
| JP | 2011-152987 | 8/2011 |
| JP | 2017-161623 | 9/2017 |

* cited by examiner

*Primary Examiner* — William J Royer
(74) *Attorney, Agent, or Firm* — Harness, Dickey and Pierce, P.L.C.

(57) ABSTRACT

A cooling device includes a sheet conveying roller, and a duct. The sheet conveying roller is configured to convey a sheet in a sheet conveyance direction. The duct is configured to convey air to a sheet conveyance passage. The duct includes a first blowing port configured to blow air toward the sheet conveyance passage, and a second blowing port configured to blow air toward the sheet conveying roller.

20 Claims, 20 Drawing Sheets

COOLING DEVICE CONFIGURED TO COOL A SHEET AND A SHEET CONVEYING ROLLER, AND IMAGE FORMING APPARATUS INCORPORATING THE COOLING DEVICE

CROSS-REFERENCE TO RELATED APPLICATION

This patent application is based on and claims priority pursuant to 35 U.S.C. § 119(a) to Japanese Patent Application No. 2019-001057, filed on Jan. 8, 2019, in the Japan Patent Office, the entire disclosure of which is incorporated by reference herein.

BACKGROUND

Technical Field

This disclosure relates to a cooling device and an image forming apparatus.

Discussion of the Background Art

Various types of cooling devices are known to include a duct to convey air to a sheet conveyance passage.

SUMMARY

At least one aspect of this disclosure provides a cooling device including a sheet conveying roller and a duct. The sheet conveying roller is configured to convey a sheet in a sheet conveyance direction. The duct is configured to convey air to a sheet conveyance passage. The duct includes a first blowing port configured to blow air toward the sheet conveyance passage, and a second blowing port configured to blow air toward the sheet conveying roller.

Further, at least one aspect of this disclosure provides an image forming apparatus including an image forming device, a fixing device, and the above-described cooling device. The image forming device is configured to form an image on a sheet. The fixing device is configured to fix the image to the sheet. The cooling device is configured to cool the sheet conveyed from the fixing device.

BRIEF DESCRIPTION OF THE SEVERAL VIEWS OF THE DRAWINGS

An exemplary embodiment of this disclosure will be described in detail based on the following figures, wherein.

DETAILED DESCRIPTION

Figure 1:
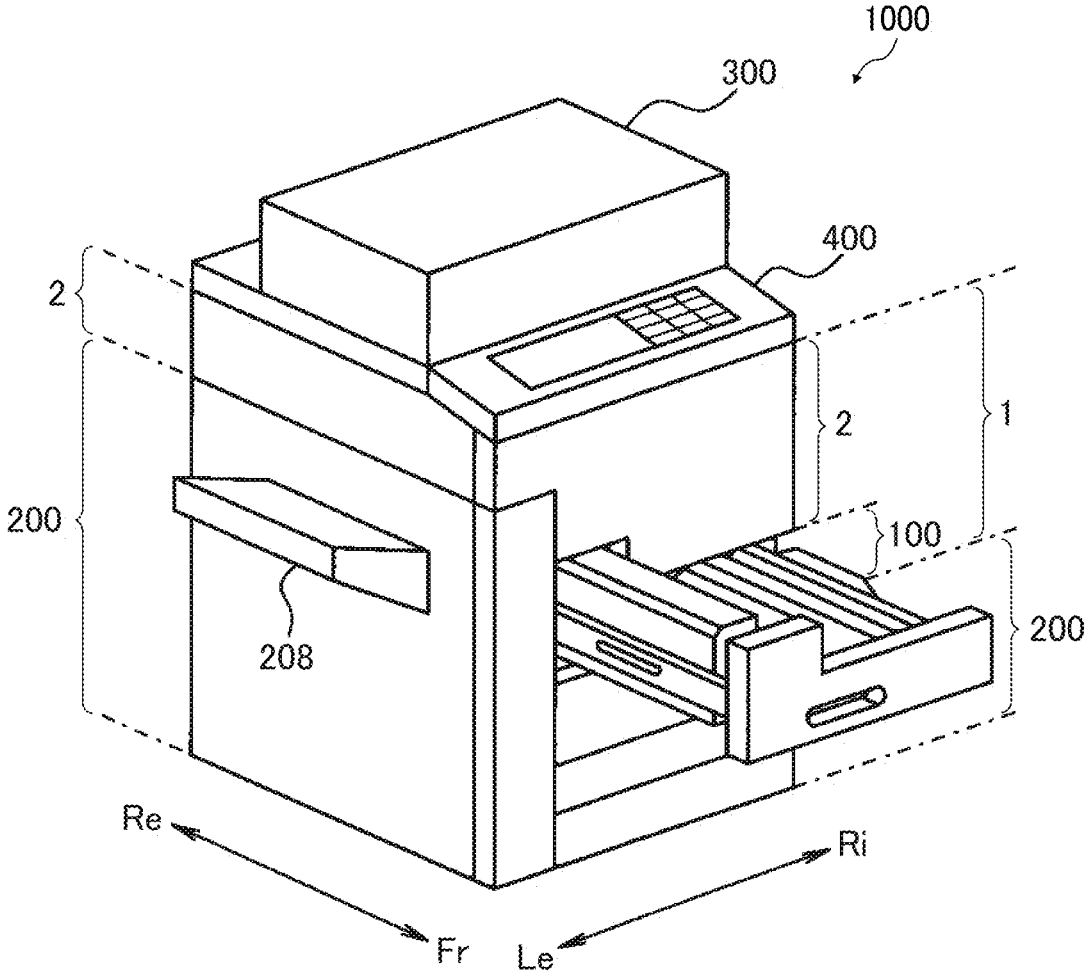
FIG. 1 is an external perspective view illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, terms such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a cooling device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any cooling device and image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a detailed description is given of an embodiment of this disclosure with reference to the drawings.

It is to be noted that elements (for example, mechanical parts and components) having the same functions and shapes are denoted by the same reference numerals throughout the specification and redundant descriptions are omitted.

First, a description is given of an image forming apparatus according to the embodiment.

FIG. 1 is an external perspective view illustrating an image forming apparatus 1000 according to an embodiment of this disclosure.

The image forming apparatus 1000 includes a printing device 1, a sheet feeding and ejecting device 200, a scanner 300, and a control panel 400. The printing device 1 forms and prints an image by an electrophotographic method. An automatic document feeder is mounted on the scanner 300.

The printing device 1 that forms an image on a sheet includes an image forming device 2 and a sheet conveying device 100. As illustrated in FIG. 1, the sheet conveying device 100 is slidably moved relative to a housing including the image forming device 2 of the printing device 1 so as to be removed from the housing of the printing device 1.

In FIG. 1, the image forming apparatus 1000 is illustrated from a diagonally left front side. An arrow Fr direction in FIG. 1 indicates a direction toward a front side of the image forming apparatus 1000 inside the image forming apparatus 1000. A direction indicated by arrow Re indicates a direction toward a rear side of the image forming apparatus 1000 inside the image forming apparatus 1000. A direction indicated by arrow Ri indicates a direction toward a right side of the image forming apparatus 1000 inside the image forming apparatus 1000. A direction indicated by arrow Le indicates a direction toward a left side of the image forming apparatus 1000 inside the image forming apparatus 1000.

Figure 2:
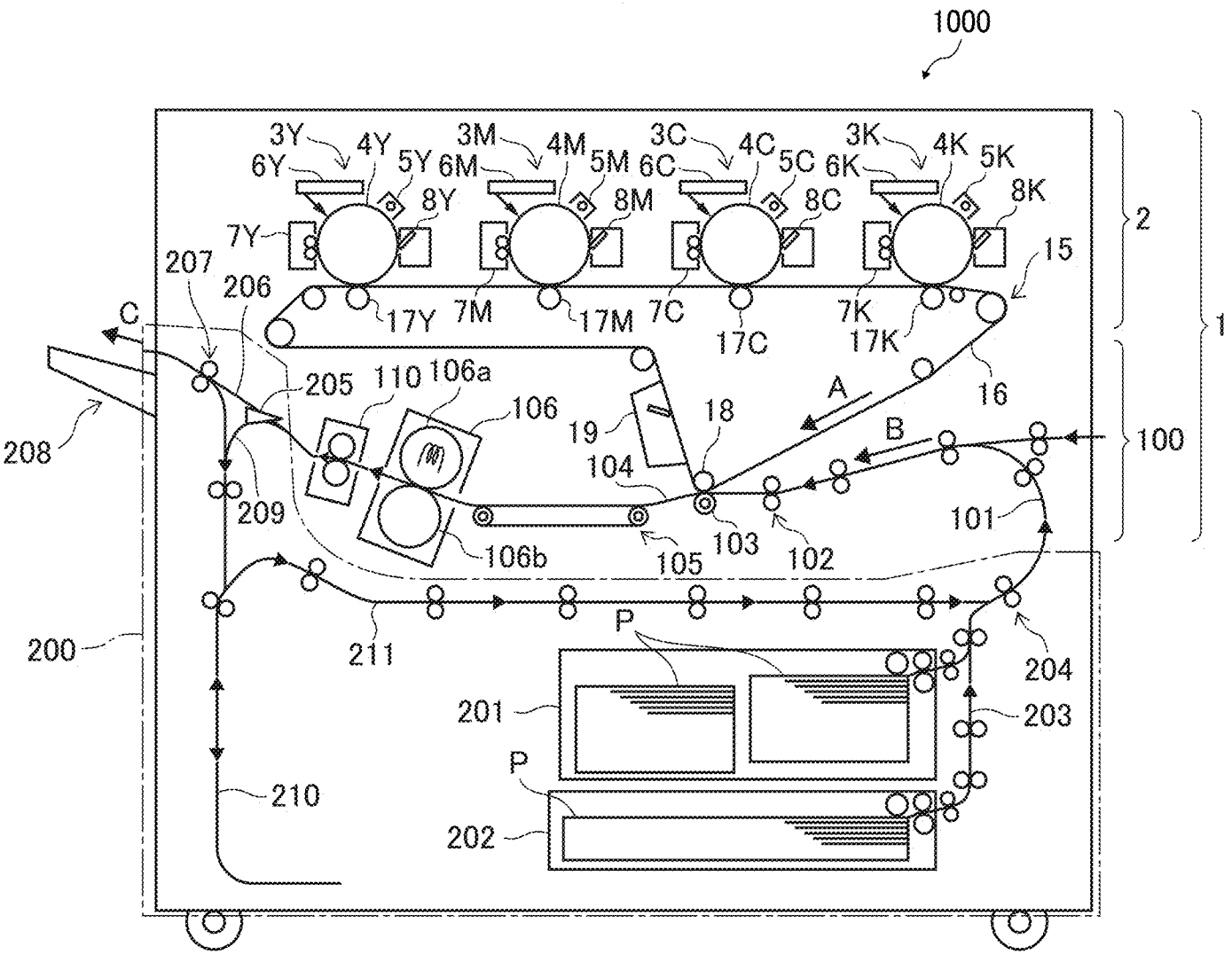
FIG. 2 is a diagram illustrating an outline of internal structures of a printing device and a sheet feeding and ejecting device of the image forming apparatus of FIG. 1, viewed from a front side of the image forming apparatus.

FIG. 2 is a diagram illustrating an outline of internal structures of the printing device 1 and the sheet feeding and ejecting device 200 of the image forming apparatus 1000 of FIG. 1, viewed from a front side of the image forming apparatus 1000.

The image forming device 2 of the printing device 1 includes image forming units 3Y, 3M, 3C, and 3K to form toner images of yellow (Y), magenta (M), cyan (C), and black (K). The image forming units 3Y, 3M, 3C, and 3K are arranged at a predetermined pitch in a lateral direction of the image forming apparatus 1000. It is to be noted that suffixes Y, M, C, and K after respective numerals indicate members or devices for forming yellow, magenta, cyan, and black toner images, respectively.

The image forming device 2 includes a sheet transfer unit 15 disposed below the image forming units 3Y, 3M, 3C, and 3K for forming yellow, magenta, cyan, and black toner images, respectively.

The image forming units 3Y, 3M, 3C, and 3K for forming yellow, magenta, cyan, and black toner images have substantially identical configurations to each other, except that the colors of toners to be used for forming respective color toner images are different from each other. Hereinafter, the configuration of each image forming unit (i.e., the image forming units 3Y, 3M, 3C, and 3K) is described without the suffixes and the image forming unit is referred to in a singular form, for example, the image forming unit 3. In addition, the following devices and units provided in each image forming unit 3 are also referred to in a singular form.

The image forming unit 3 (i.e., the image forming units 3Y, 3M, 3C, and 3K) includes a drum-shaped photoconductor 4 (i.e., photoconductors 4Y, 4M, 4C, and 4K). Furthermore, the image forming unit 3 includes an electric charger 5 (i.e., electric chargers 5Y, 5M, 5C, and 5K), an exposure device 6 (i.e., exposure devices 6Y, 6M, 6C, and 6K), a developing device 7 (i.e., developing devices 7Y, 7M, 7C, and 7K), and a drum cleaning device 8 (i.e., drum cleaning devices 8Y, 8M, 8C, and 8K). The electric charger 5, the exposure device 6, the developing device 7, and the drum cleaning device 8 are disposed around the photoconductor 4.

In the image forming unit 3, the photoconductor 4 is rotationally driven in a counterclockwise direction in FIG. 2, and a circumferential surface of the photoconductor 4 is uniformly charged by the electric charger 5 at a position facing the electric charger 5. According to this configuration, a polarity of the circumferential surface of the photoconductor 4 becomes the same as a charging polarity of the toner. After the surface of the photoconductor 4 is uniformly charged, the surface of the photoconductor 4 is optically scanned by the exposure device 6 that emits laser light modulated based on image data. An irradiated area of the surface of the photoconductor 4 exposed by the optical scanning has potential attenuated to carry an electrostatic latent image.

A corresponding toner of the yellow, magenta, cyan, and black toners is made to selectively adhere by the developing device 7 to develop the electrostatic latent image into a visible toner image. With rotation of the photoconductor 4, the toner image enters a primary transfer nip region at which the toner image is transferred. The primary transfer nip region is formed by contact between the photoconductor 4 and an intermediate transfer belt 16. The details of the intermediate transfer belt 16 is described below.

The sheet transfer unit 15 moves the intermediate transfer belt 16 endlessly in a direction indicated by arrow A in FIG. 2 by rotating one of a plurality of rollers while the intermediate transfer belt 16 is wound and stretched around the plurality of rollers disposed inside a loop of the intermediate transfer belt 16.

Among the plurality of rollers disposed inside the loop of the intermediate transfer belt 16, a primary transfer roller 17 (i.e., primary transfer rollers 17Y, 17M, 17C, and 17K) for transferring the toner image interposes the intermediate transfer belt 16 in a space with the photoconductor 4 that carries the toner image. With this configuration, the primary transfer nip region is formed by the contact between the photoconductor 4 and an outer circumferential surface of the intermediate transfer belt 16.

The primary transfer roller 17 is applied with primary transfer bias having a polarity opposite to the charging polarity of the toner. With this configuration, a primary transfer electric field is formed at the primary transfer nip region, and the primary transfer electric field electrostatically moves the toner image formed on the photoconductor 4, from the surface of the photoconductor 4 onto the surface of the intermediate transfer belt 16. The toner image on the photoconductor 4 is primarily transferred onto the outer circumferential surface of the intermediate transfer belt 16 by an action of the primary transfer electric field and an action of a nip pressure at the primary transfer nip region.

After the photoconductor 4 has passed through the primary transfer nip region, transfer residual toner that has not been primarily transferred onto the intermediate transfer belt 16 remains on the surface of the photoconductor 4. The transfer residual toner is removed from the surface of the photoconductor 4 by the drum cleaning device 8.

The above-described electrophotographic processes are performed with each of the image forming units 3Y, 3M, 3C, and 3K for forming respective yellow, magenta, cyan, and black toner images.

To be more specific, the primary transfer rollers 17Y, 17M, 17C, and 17K are aligned inside the loop of the intermediate transfer belt 16 and interpose the intermediate transfer belt 16 in a space with the photoconductors 4Y, 4M, 4C, and 4K, respectively. With this configuration, the primary transfer nip regions for transferring the yellow, magenta, cyan, and black toner images are formed by contact between the outer circumferential surface of the intermediate transfer belt 16 and the photoconductors 4Y, 4M, 4C, and 4K.

According to the order of the alignment of the photoconductors 4Y, 4M, 4C, and 4K, the yellow toner is first transferred onto the outer circumferential surface of the intermediate transfer belt 16 in the process of primary transfer. Then, the magenta, cyan, and black toner images are transferred at the respective primary transfer nip regions in a manner sequentially superimposed on the yellow toner image that has been primarily transferred onto the outer circumferential surface of the intermediate transfer belt 16. With this structure, a four-color composite toner image is formed on the outer circumferential surface of the intermediate transfer belt 16.

A secondary transfer roller 103 is disposed below the intermediate transfer belt 16. The secondary transfer roller 103 interposes the intermediate transfer belt 16 in a space with a secondary transfer counter roller 18 disposed inside the loop of the intermediate transfer belt 16. With this configuration, a secondary transfer nip region is formed by contact between the outer circumferential surface of the intermediate transfer belt 16 and the secondary transfer roller 103. In the secondary transfer nip region, a secondary electric field is formed between the secondary transfer counter roller 18 and the secondary transfer roller 103. The secondary transfer counter roller 18 is applied with a secondary transfer bias having a polarity the same as a charging polarity of the toner. The secondary transfer roller 103 is electrically grounded.

The four-color composite toner image on the outer circumferential surface of the intermediate transfer belt 16 enters the secondary transfer nip region along with the endless movement of the intermediate transfer belt 16.

The sheet feeding and ejecting device 200 of the image forming apparatus 1000 includes a sheet feed bank 201 and a sheet feed tray 202 below the sheet conveying device 100 of the printing device 1. A sheet P fed out from the sheet feed bank 201 or the sheet feed tray 202 into a sheet feed passage 203 is conveyed upward by a plurality of pairs of sheet conveying rollers disposed along the sheet feed passage 203 in a direction indicated by B in FIG. 2. Then, the sheet P is delivered into a sheet conveyance passage 101 of the sheet conveying device 100 of the printing device 1 by a pair of sheet transfer rollers 204 provided near a terminal of the sheet feed passage 203.

The sheet P that has been transferred from the sheet feed passage 203 to the sheet conveyance passage 101 is conveyed by a plurality of pairs of sheet conveying rollers disposed along the sheet conveyance passage 101. When the sheet P contacts a registration nip region between a pair of sheet registration rollers 102 disposed near a terminal of the sheet conveyance passage 101, skew of the sheet P is corrected. Thereafter, the sheet P is conveyed to the secondary transfer nip region by rotating the pair of sheet registration rollers 102 at a timing synchronized with the four-color composite toner image on the intermediate transfer belt 16.

The four-color composite toner image is secondarily transferred by an action of the secondary transfer electric field and an action of the nip pressure onto the sheet P that is brought to closely contact with the four-color composite toner image on the intermediate transfer belt 16 at the secondary transfer nip region. Consequently, a full-color image is formed on the sheet P of white color.

After the intermediate transfer belt 16 has passed through the secondary transfer nip region, transfer residual toner that has not been secondarily transferred onto the sheet P remains on the outer circumferential surface of the intermediate transfer belt 16. The transfer residual toner is removed from the intermediate transfer belt 16 by a belt cleaning device 19.

The sheet conveying device 100 of the printing device 1 further includes a post-transfer conveyance passage 104, a sheet conveyance belt unit 105, a fixing device 106, and a conveyance cooling unit 110, in addition to the sheet conveyance passage 101, the pair of sheet registration rollers 102, and the secondary transfer roller 103.

The sheet P that has passed through the secondary transfer nip region is conveyed to the post-transfer conveyance passage 104. The post-transfer conveyance passage 104 runs through the sheet conveyance belt unit 105, the fixing device 106, and the conveyance cooling unit 110.

The sheet P conveyed to the post-transfer conveyance passage 104 is first conveyed from the right side to the left side of the image forming apparatus 1000 by the sheet conveyance belt unit 105, and then conveyed into the fixing device 106.

The fixing device 106 forms a fixing nip region by contact between a fixing roller 106*a* and a pressure roller 106*b* pressed against the fixing roller 106*a*. The fixing roller 106*a* includes a heat source such as a halogen lamp. The sheet P conveyed into the fixing device 106 enters the fixing nip region to receive application of heat and pressure. Consequently, a full-color image is fixed to the surface of the sheet P.

The sheet P that has passed through the fixing device 106 passes through the conveyance cooling unit 110, and then is conveyed to a left end of the sheet feeding and ejecting device 200.

The left end of the sheet feeding and ejecting device 200 is provided with a switching claw 205, a sheet ejection passage 206, a pair of sheet ejection rollers 207, a return passage 209, and a switchback passage 210. Additionally, a reentry passage 211 is disposed above the sheet feed bank 201 in the sheet feeding and ejecting device 200.

The switching claw 205 selects a subsequent conveyance destination of the sheet P that has been delivered to the left end of the sheet feeding and ejecting device 200 from the conveyance cooling unit 110 of the sheet conveying device 100 of the printing device 1. The sheet ejection passage 206 is selected as the conveyance destination of the sheet P when single-sided printing in a single-side printing mode to form an image on one side of the sheet P is finished or double-sided printing in a duplex printing mode to form an image on both faces of the sheet P is finished. The sheet P that has been conveyed to the sheet ejection passage 206 passes through the pair of sheet ejection rollers 207, and then is ejected to the outside of the image forming apparatus 1000 in a direction indicated by C in FIG. 2, to be stacked on a sheet stacker 208.

On the other hand, when single-sided printing in the duplex printing mode is finished, in other words, an image is formed on one side or a first side of the sheet P, the return passage 209 is selected as the conveyance destination of the sheet P. The sheet P that has been conveyed to the return passage 209 enters the switchback passage 210, and then is turned upside down by a switchback operation to be conveyed to the reentry passage 211. Then, the sheet P passes through the reentry passage 211, and then is conveyed again to the sheet conveyance passage 101. Thereafter, a full-color image is secondarily transferred onto the other side or a second side of the sheet P at the secondary transfer nip region. Then, the sheet P sequentially passes through the fixing device 106, the conveyance cooling unit 110, the sheet ejection passage 206, and the pair of sheet ejection rollers 207, and is eventually ejected to the outside of the image forming apparatus 1000.

The sheet P that has passed through the fixing device 106 is high in temperature. In recent years, a printing speed is remarkably accelerated, and in a case in which the sheet P is conveyed while having high temperature, the face of a sheet P with an image is likely to be streaked or scratched due to a load of a guide member or a blocking phenomenon in which sheets P stick to each other is likely to occur.

The conveyance cooling unit 110 is configured to cool a sheet P conveyed from the fixing device 106 while conveying the sheet P.

Figure 3:
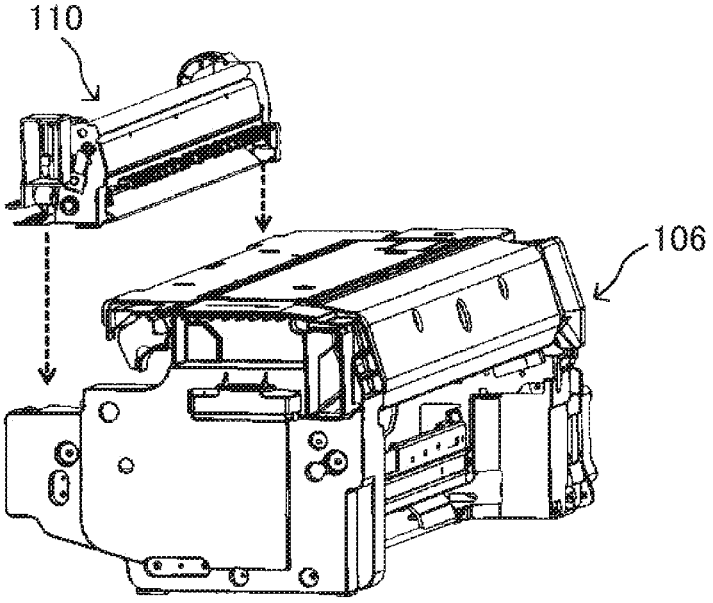
FIG. 3 is a perspective view illustrating a fixing device and a conveyance cooling unit.

FIG. 3 is a perspective view illustrating the fixing device 106 and the conveyance cooling unit 110.

As indicated by an arrow in FIG. 3, the conveyance cooling unit 110 is installed in the fixing device 106 so that a sheet P is cooled while the conveyance cooling unit 110 is conveying the sheet P immediately after the sheet P is ejected from the fixing device 106.

Figure 4:
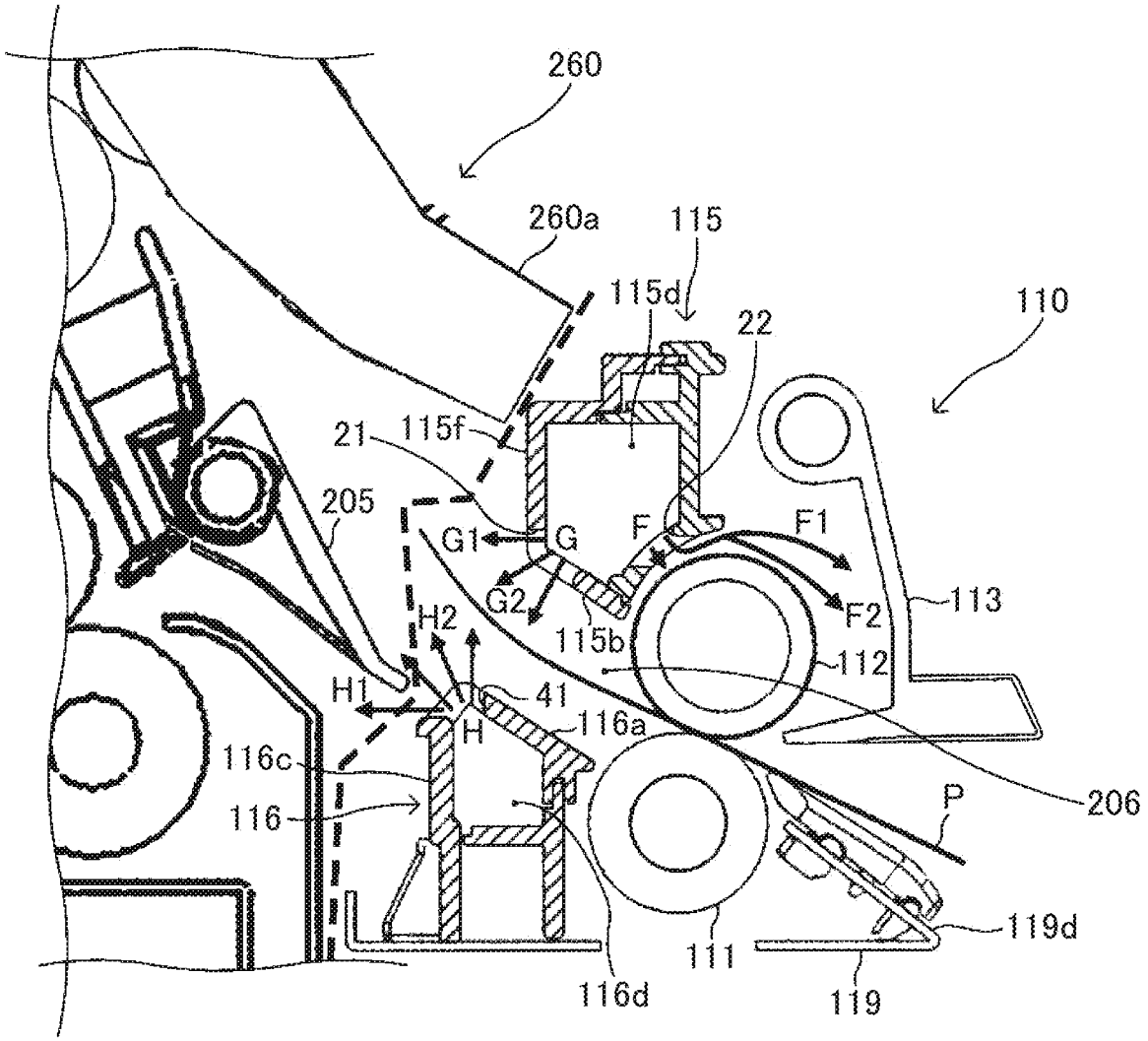
FIG. 4 is a transverse cross-sectional view illustrating the conveyance cooling unit together with a sheet being conveyed.

FIG. 4 is a transverse cross-sectional view illustrating the conveyance cooling unit 110 together with the sheet P being conveyed.

The conveyance cooling unit 110 forms a conveyance nip region by contact between a drive roller 111 that performs rotational drive and a driven roller 112 pressed against the drive roller 111, so that the conveyance cooling unit 110 applies conveyance force to the sheet P sandwiched by the drive roller 111 and the driven roller 112 at the conveyance nip region.

The conveyance cooling unit 110 further includes an upper nip guide member 113, a lower nip guide member 119*d*, an upper air duct 115, and a lower air duct 116. The lower nip guide member 119*d* is provided at a sheet metal frame 119. The sheet P that has been conveyed from the fixing device 106 immediately before reaching the conveyance cooling unit 110 is conveyed through between the upper nip guide member 113 and the lower nip guide member 119*d* to be guided toward the conveyance nip region.

The upper air duct 115 that functions as a duct includes a plurality of upper conveyance passage blowout ports 21 and a plurality of roller blowout ports 22. The plurality of upper conveyance passage blowout ports 21 are provided at predetermined intervals in a sheet width direction (also referred to as an axial direction of the driven roller 112 and a duct longitudinal direction). The plurality of upper conveyance passage blowout ports 21 blows out air toward the sheet ejection passage 206 that is a sheet conveyance passage. The roller blowout ports 22 are also provided at predetermined intervals in the sheet width direction (i.e., the axial direction of the driven roller 112 and the duct longitudinal direction). The plurality of roller blowout ports 22 face the driven roller 112 that functions as a sheet conveying roller to blow out the air toward the driven roller 112.

Additionally, the lower air duct 116 that is a second duct includes lower conveyance passage blowout ports 41 that blow out the air toward the sheet ejection passage 206.

As indicated by arrow G in FIG. 4, the cooling air that has been conveyed to an upper air blowing passage 115*d* of the upper air duct 115 is blown from the plurality of upper conveyance passage blowout ports 21 onto an upper surface of the sheet P that has passed through the conveyance nip region. Additionally, as indicated by arrow H in FIG. 4, the cooling air that has been conveyed to a lower air blowing passage 116*d* of the lower air duct 116 is blown from the lower conveyance passage blowout ports 41 onto a lower surface of the sheet P that has passed through the conveyance nip region. Consequently, the sheet P heated at the fixing device 106 is cooled from both the upper surface side and the lower surface side of the sheet P.

The sheet P to which the image has been fixed by the fixing device 106 is conveyed to the conveyance nip region between the driven roller 112 and the drive roller 111 while the sheet P is kept in the high temperature. In the conveyance nip region, the heat of the sheet P is transmitted to the driven roller 112 and the drive roller 111, and both the temperature of the driven roller 112 and the temperature of the drive roller 111 rise. In a case in which sheets P are brought to pass continuously, heat exchanged from the sheets to the pair of the rollers, which are the drive roller 111 and the driven roller 112, is performed because the drive roller 111 and the driven roller 112 have the temperatures lower than the temperatures of the sheets in an initial stage. However, the heat exchange is not performed on a sheet P nipped between the drive roller 111 and the driven roller 112 having the temperatures that have gradually risen, and the sheet P is conveyed to a downstream side while the sheet P is keeping the high temperature. As a result, it is likely that the sheet temperature is not lowered to a target temperature by the cooling performed by blowing the air from the upper air duct 115 and the lower air duct 116, and the blocking phenomenon in which sheets P stick to each other may occur.

Also, in the case in which the sheets P are brought to pass continuously, it is likely that a surface temperature of the driven roller 112 or a surface temperature of the drive roller 111 rises to a temperature close to a toner melting point. In a case in which the surface temperature of the driven roller 112 or the surface temperature of the drive roller 111 rises to the temperature close to the toner melting point, the toner on the sheet P may adhere to the surface of the drive roller 111 or the surface of the driven roller 112. Thus, when the toner adheres to the surface of the drive roller 111 or the surface of the driven roller 112, the conveyed sheet P tends to stick to the drive roller 111 or the driven roller 112, and the sheet P may be wound around the drive roller 111 or the driven roller 112 along an outer diameter of the drive roller 111 or the driven roller 112. Consequently, conveyance failure may occur, thereby causing paper jam inside the fixing device 106. Particularly, the driven roller 112 contacts the surface of a side on which the fixing roller 106*a* to heat the sheet P contacts. Therefore, the temperature of the driven roller 112 rises more easily than the drive roller 111 does. Furthermore, since the toner image immediately after the fixing process contacts the driven roller 112, toner adhesion is likely to occur.

However, in the present embodiment, as indicated by arrow F in FIG. 4, the cooling air is directly conveyed toward the driven roller 112 at a short distance from the roller blowout ports 22 provided in the upper air duct 115 and facing the driven roller 112. Consequently, an effect of constantly cooling the driven roller 112 is obtained. As a result, cooling is performed at the same time when the temperature of the driven roller 112 rises due to the sheet passage, and the temperature of the driven roller 112 is restrained from rising. Consequently, the toner is restrained from adhering to the driven roller 112, and the conveyed sheet is prevented from being wound around the driven roller 112.

Additionally, while the sheet P is not passing, the heat of the drive roller 111 is transmitted to the driven roller 112, and the temperature of the drive roller 111 is restrained from rising. Furthermore, the cooling is performed at the same time when the heat of the drive roller 111 is transmitted to the driven roller 112 and the temperature of the driven roller 112 rises. Consequently, the temperature of the drive roller 111 is restrained from rising, and toner adhesion onto the surface of the drive roller 111 is prevented. Accordingly, the conveyed sheet is prevented from being wound around the drive roller 111.

Furthermore, since the temperature of the driven roller 112 and the temperature of the drive roller 111 are restrained from rising, heat exchange is excellently performed on the sheet P in the conveyance nip region, and the temperature of the sheet P is lowered. Consequently, the cooling by blowing the air from the upper air duct 115 and the lower air duct 116 excellently lowers the sheet temperature to the target temperature and further restrains occurrence of the blocking phenomenon in which the sheets P stick to each other.

The driven roller 112 may include a metal roller. In the case in which a material of the driven roller 112 is metal, the roller temperature tends to be higher because thermal conductivity of the metal is higher than thermal conductivity of a rubber member. Therefore, with this configuration of the present embodiment in which the driven roller 112 is directly cooled by the air, the temperature of the driven roller 112 is effectively restrained, the heat exchange with the sheet P is enhanced, and the sheet P is excellently cooled in the conveyance nip region.

The driven roller 112 may also be a member obtained by casing a surface of the driven roller 112 with a material such as a hollow film material to which the toner hardly adheres. Furthermore, the surface of the driven roller 112 is preferably made conductive. Since the surface of the driven roller 112 is conductive, an effect of restraining electrical charge of the driven roller 112 is achieved.

Moreover, the driven roller 112 may have a member obtained by covering an outer shape of a cored bar with a rubber member such as silicon, and by further casing the covered cored bar with a material such as perfluoroalkoxy alkane (PFA) to which the toner hardly adheres. At this time, it is preferable to adopt a method in which the rubber member is made conductive so as to ground static electricity to the earth when the static electricity is generated at the time of sheet passage. Consequently, the driven roller 112 is prevented from being electrically charged. The casing with the PFA is omitted when the rubber member is made to contain a material such as polytetrafluoroethylene (PTFE) to which the toner hardly adheres, or the surface of the driven roller 112 is coated with such a material.

Additionally, in the present embodiment, even when the sheet P is not present in the conveyance cooling unit 110, the cooling air is continuously blown out from the plurality of upper conveyance passage blowout ports 21, the plurality of roller blowout ports 22, and the lower conveyance passage blowout ports 41. Consequently, the temperature of the driven roller 112 is excellently restrained from rising. Furthermore, even when the sheet P is not present in the conveyance cooling unit 110, the cooling air is continuously blown out from the plurality of upper conveyance passage blowout ports 21 and the plurality of lower conveyance passage blowout ports 41. Therefore, the air blown out from the plurality of upper conveyance passage blowout ports 21 flows to a sheet ejection unit 260 located more on a left side than a broken line in FIG. 4 and cools the sheet ejection unit 260.

The plurality of upper conveyance passage blowout ports 21 are provided on a downstream side in a sheet conveyance direction (hereinafter, also simply referred to as a conveyance direction) of an upper sheet guide face 115*b* of the upper air duct 115 facing the upper surface of the sheet P conveyed along the sheet ejection passage 206. The plurality of upper conveyance passage blowout ports 21 extend to a downstream end of the plurality of upper conveyance passage blowout ports 21, and further extend to a lower side of a downstream side wall 115*f* located on the downstream side in the conveyance direction of the upper air duct 115. With this configuration, a downstream end in the conveyance direction of each of the plurality of upper conveyance passage blowout ports 21 is located at a position more retracted from the sheet ejection passage 206, than the upper sheet guide face 115*b* is. As a result, a leading end of a sheet P is prevented from being caught at the downstream end in the conveyance direction of any of the plurality of upper conveyance passage blowout ports 21, and occurrence of sheet edge folding error or occurrence of conveyance failure is prevented.

Furthermore, since the plurality of upper conveyance passage blowout ports 21 extend to the lower side of the downstream side wall 115*f*, the cooling air is blown out not only toward the lower air duct 116 (arrow G2 in FIG. 4) but also toward the sheet ejection unit 260 located more on the left side than the broken line in FIG. 4 (arrow G1 in FIG. 4). Consequently, the cooling air is blown onto a broad range of the upper surface of the sheet P, and the temperature of the sheet P is excellently decreased.

Additionally, since the cooling air is blown toward the sheet ejection unit 260 (arrow G1 in FIG. 4), the cooling air is brought to excellently flow toward the sheet ejection unit 260 while the sheet P is not passing, and the temperature of the sheet ejection unit 260 is restricted from rising.

Furthermore, similar to the plurality of upper conveyance passage blowout ports 21, the plurality of lower conveyance passage blowout ports 41 are also provided on the downstream side in the conveyance direction of a lower sheet guide face 116*a* of the lower air duct 116 facing a lower surface of the sheet P conveyed along the sheet ejection passage 206. The plurality of lower conveyance passage blowout ports 41 extend to a downstream end in the conveyance direction and further extend to an upper side of a downstream side wall 116*c* of the lower air duct 116. With this configuration, a downstream end of the plurality of lower conveyance passage blowout ports 41 are located at respective positions more retracted from the sheet ejection passage 206 than the lower sheet guide face 116*a* is. Therefore, the leading end of the sheet P is prevented from being caught at the downstream end in the conveyance direction of the plurality of lower conveyance passage blowout ports 41, and occurrence of sheet edge folding error or occurrence of conveyance failure is prevented.

Additionally, since the plurality of lower conveyance passage blowout ports 41 extend to the upper side of the downstream side wall 116*c*, the cooling air is blown out not only toward the sheet ejection passage 206 (arrow H2 in FIG. 4) but also toward the sheet ejection unit 260 located more on the left side than the broken line in FIG. 4 (arrow H1 in FIG. 4). Consequently, a part of the cooling air blown out from the plurality of lower conveyance passage blowout ports 41 is brought to flow to the sheet ejection unit 260, and the sheet ejection unit 260 is excellently cooled.

Furthermore, in the present embodiment, among the cooling air blown out from the roller blowout ports 22, the cooling air, which flows along the surface of the driven roller 112 and is directed to the upstream side in the conveyance direction as indicated by arrows F1 and F2 in FIG. 4, is blocked by the upper nip guide member 113. Consequently, the cooling air blown out from the roller blowout port 22 is restrained from flowing to the fixing device 106, the temperature of the fixing device 106 (i.e., the fixing roller 106*a*) is restrained from falling (dropping), and occurrence of fixing failure is prevented.

Next, a detailed description is given of a configuration of the conveyance cooling unit 110 according to the present embodiment of this disclosure.

Figure 5:
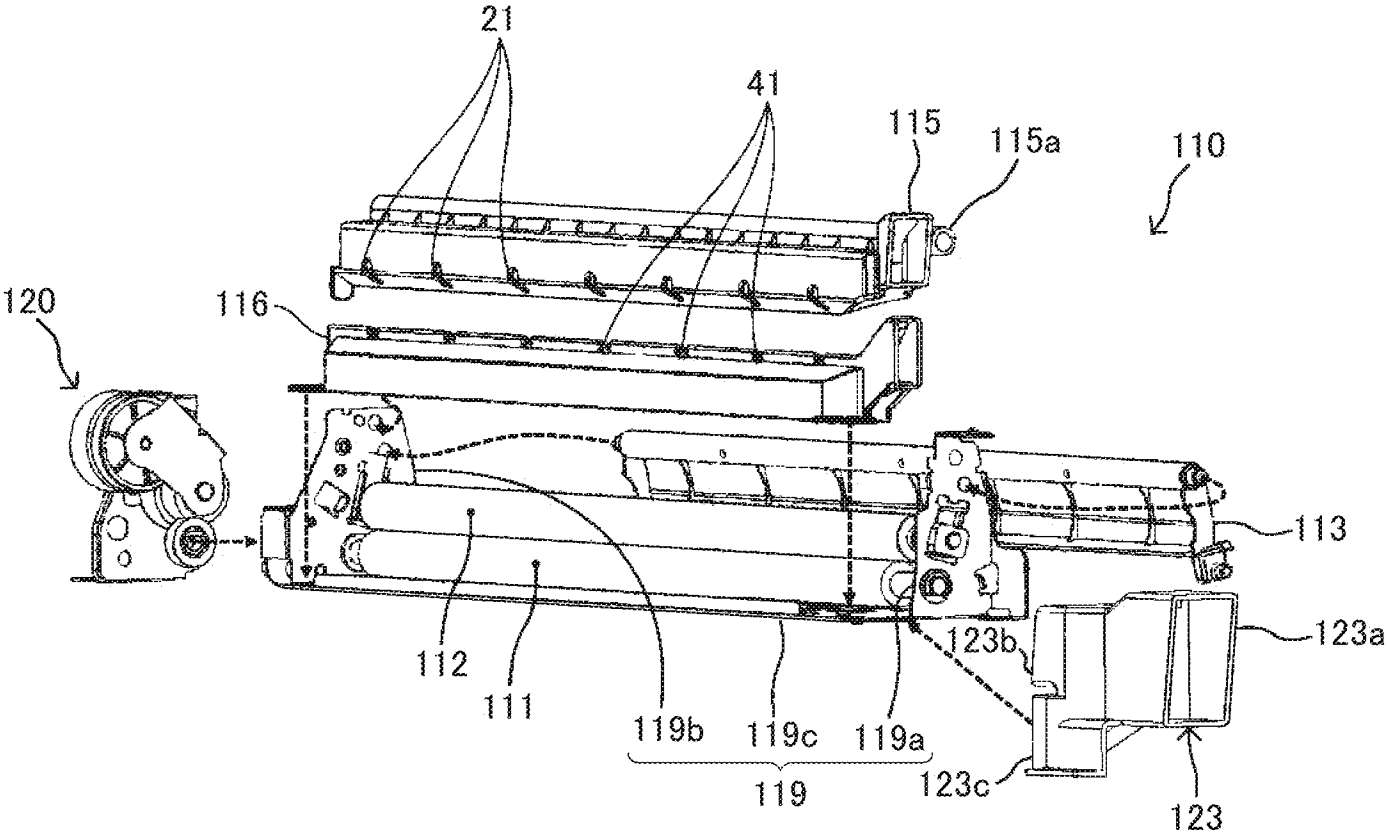
FIG. 5 is an exploded perspective view illustrating the conveyance cooling unit.

FIG. 5 is an exploded perspective view illustrating the conveyance cooling unit 110.

The sheet metal frame 119 of the conveyance cooling unit 110 includes a front plate 119*a*, a rear plate 119*b*, and a bottom plate 119*c*. It is to be noted that the above-described lower nip guide member (i.e., the lower nip guide member 119*d* in FIG. 4) is also integrally formed with the sheet metal frame 119 as a single unit.

The lower air duct 116 is fixed to an upper surface of the bottom plate 119*c* of the sheet metal frame 119. The upper air duct 115 is rotatably supported by the front plate 119*a* and the rear plate 119*b* in a state in which a front support shaft 117 and a rear support shaft 125 (see FIGS. 7A and 7B) are inserted into through holes of supports 115*a* provided at respective ends in the duct longitudinal direction. The plurality of upper conveyance passage blowout ports 21 are provided at the predetermined intervals in the duct longitudinal direction (that is also the axial direction of the driven roller 112, the sheet width direction, and the front-rear direction of the image forming apparatus 1000). Similarly, the plurality of lower conveyance passage blowout ports 41 are also provided at predetermined intervals in the duct longitudinal direction.

The drive roller 111 and the driven roller 112 are rotatably supported by bearings provided on the front plate 119*a* and bearings provided on the rear plate 119*b*. A drive transmission mechanism 120 to transmit drive force to the drive roller 111 is fixed to a back surface of the rear plate 119*b* of the sheet metal frame 119. Additionally, a communication pipe 123 is fixed to an end on the downstream side in the conveyance direction of the front plate 119*a* of the sheet metal frame 119.

The communication pipe 123 includes a receiver 123*a*, a first communicating portion 123*b*, and a second communicating portion 123*c*. The cooling air taken in from the outside of the image forming apparatus 1000 flows into the receiver 123*a*. The first communicating portion 123*b* communicates with the upper air duct 115 and conveys the cooling air to the upper air duct 115. The second communicating portion 123*c* communicates with the lower air duct 116 and conveys the cooling air to the lower air duct 116.

Figure 6:
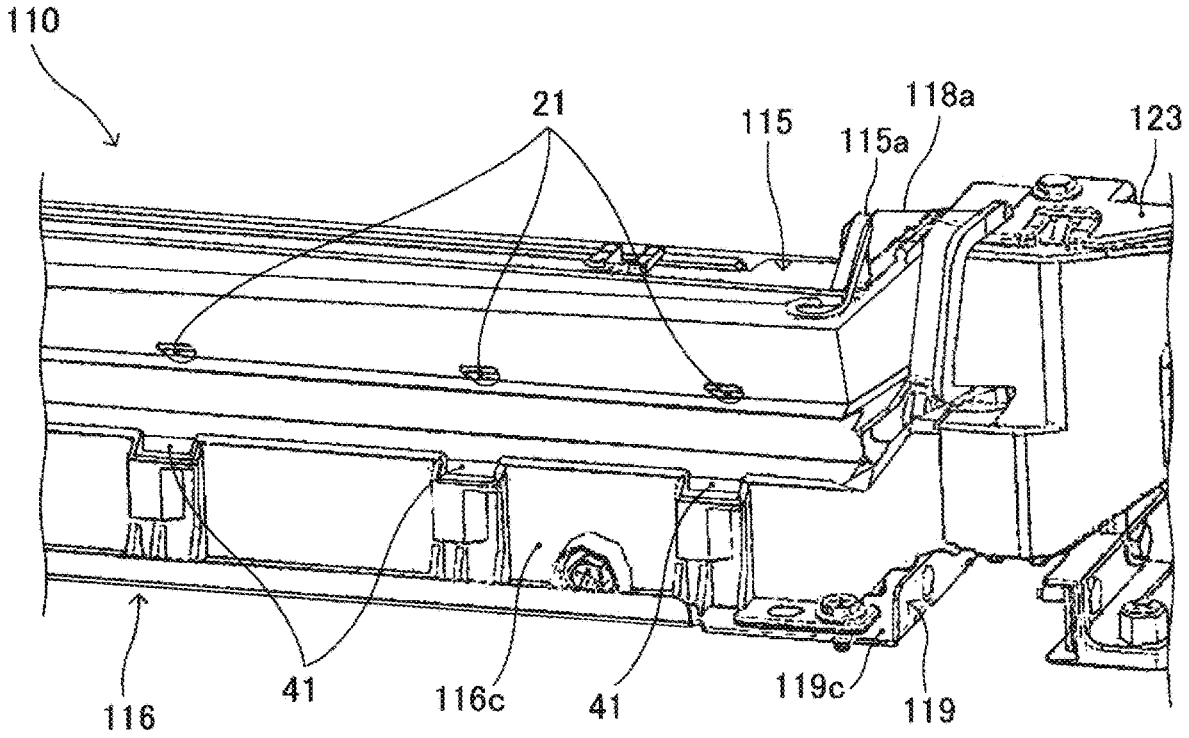
FIG. 6 is an enlarged perspective view illustrating a main part of the conveyance cooling unit.

FIG. 6 is an enlarged perspective view illustrating a main part of the conveyance cooling unit 110.

As illustrated in FIG. 6, each of the plurality of lower conveyance passage blowout ports 41 of the lower air duct 116 and each of the plurality of upper conveyance passage blowout ports 21 of the upper air duct 115 are provided at the same position in the sheet width direction. Additionally, the upper air duct 115 is biased toward the side of the lower air duct 116 by a front torsion spring 118*a*.

Figure 7A:
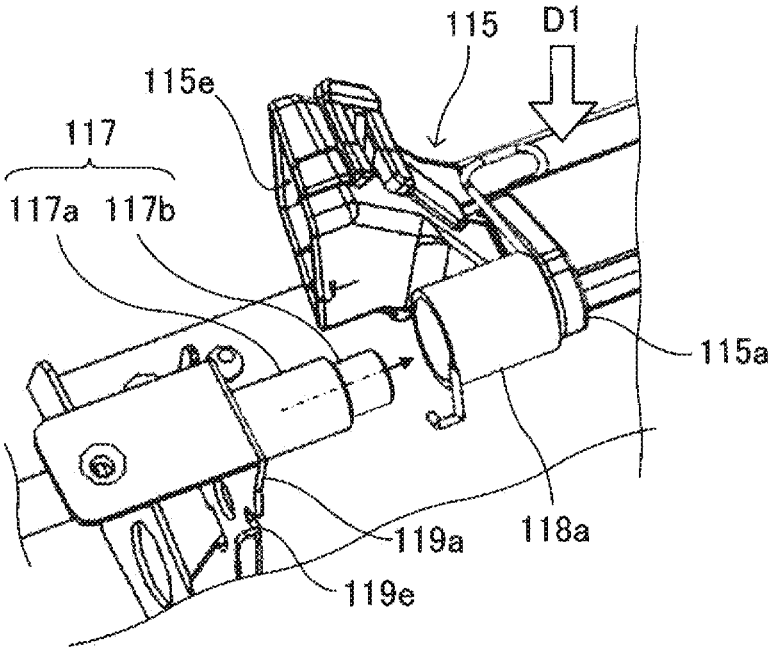
FIG. 7A is a partial perspective view partially illustrating a front plate and an area near the front plate.
Figure 7B:
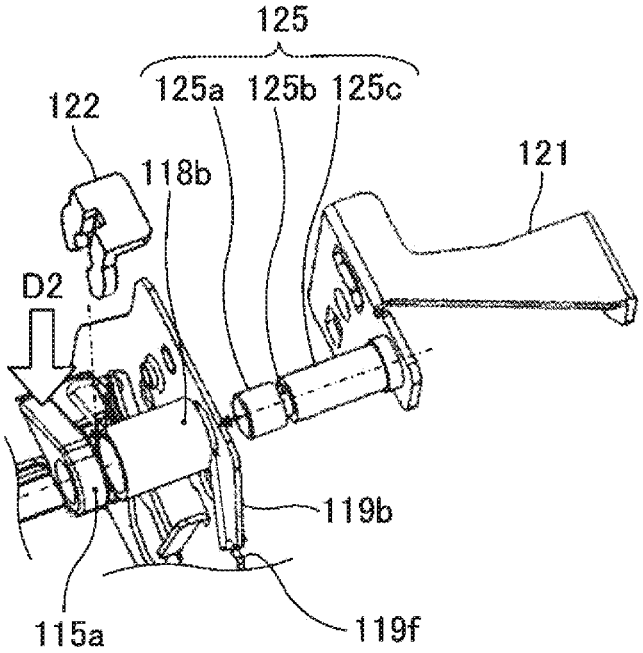
FIG. 7B is a partial perspective view partially illustrating a rear plate and an area near the rear plate.

FIG. 7A is a partial perspective view partially illustrating the front plate 119*a* and the area near the front plate 119*a*. FIG. 7B is a partial perspective view partially illustrating the rear plate 119*b* and the area near the rear plate 119*b*.

As illustrated in FIG. 7A, the front plate 119*a* includes the front support shaft 117 by which the support 115*a* of the upper air duct 115 is supported. The front support shaft 117 includes a spring support 117*a* and a duct support 117*b*. The front torsion spring 118*a* that functions as a biasing member is inserted into the spring support 117*a*. The support 115*a* on the front side of the upper air duct 115 is inserted into the duct support 117*b*. The duct support 117*b* has a diameter smaller than a diameter of the spring support 117*a*.

The front torsion spring 118*a* has one end that is hooked to a front spring hooking portion 119*e* provided on the front plate 119*a*, and the other end that contacts the upper air duct 115 to bias the upper air duct 115 in a direction indicated by arrow D1 in FIG. 7A. The direction of the arrow D1 is a direction toward the lower air duct 116.

As illustrated in FIG. 7B, the rear plate 119*b* is fastened to a duct support member 121 rotatably supporting the upper air duct 115. The duct support member 121 is provided with the rear support shaft 125. The rear support shaft 125 includes, sequentially from a root side of the rear support shaft 125, a duct support 125*a*, a groove 125*b*, and a spring support 125*c*. A rear torsion spring 118*b* is inserted into the spring support 125*c*. A guard ring 122 is fitted into the groove 125*b*. The support 115*a* on the rear side of the upper air duct 115 is inserted into the duct support 125*a*.

The rear torsion spring 118*b* has one end that is hooked to a rear spring hooking portion 119*f* provided on the rear plate 119*b*, and has the other end that contacts the upper air duct 115 to bias the rear side of the upper air duct 115 in a direction indicated by arrow D2 in FIG. 7B. The direction D2 is a direction toward the lower air duct 116.

Additionally, the guard ring 122, which is set between the rear torsion spring 118*b* and the support 115*a* on the rear side of the upper air duct 115, is fitted to the rear support shaft 125 to regulate movement of the upper air duct 115 in the front-rear direction of the upper air duct 115. The upper air duct 115 is prevented from falling off from the front support shaft 117 and the rear support shaft 125.

Thus, in the present embodiment, since the respective supports 115*a* provided on both sides in the front-rear direction (in other words, the duct longitudinal direction) of the upper air duct 115 are inserted into the front support shaft 117 and the rear support shaft 125, respectively, the upper air duct 115 is rotatably supported while using the front support shaft 117 and the rear support shaft 125 as rotation axes. With this configuration, the upper air duct 115 is moved between an opposing position (that is, a position illustrated in FIG. 4) at which the upper air duct 115 faces the sheet ejection passage 206 and a retracted position at which the upper air duct 115 is retracted from the opposing position.

Additionally, in the present embodiment, both ends in the longitudinal direction of the upper air duct 115 (i.e., the front-rear direction of the image forming apparatus 1000) are biased toward the side of the lower air duct 116 (so as to locate the upper air duct 115 at the opposing position). Consequently, when the sheet P contacts the upper air duct 115 while the sheet P is passing, the upper air duct 115 is prevented from unsteadily being moved in a direction away from the lower air duct 116 by conveyance force for the sheet P.

It is to be noted that, in the present embodiment, the torsion spring (i.e., the front torsion spring 118*a* and the rear torsion spring 118*b*) is used as a biasing member to bias the upper air duct 115 toward the opposing position. However, the configuration is not limited to the above-described configuration and a tension spring may bias the upper air duct 115. In the present embodiment, both ends in the longitudinal direction of the upper air duct 115 are biased by the biasing member. However, this configuration is an example. For example, depending on the strength of the upper air duct 115, one side of the upper air duct 115 may be biased or a center in the duct longitudinal direction of the upper air duct 115 may be biased.

Additionally, in the present embodiment, the front support shaft 117 is provided on the front plate 119*a* and the duct support member 121 is fastened to the rear plate 119*b*. However, the front support shaft 117 may be provided on the rear plate 119*b* and the duct support member 121 may be fastened to the front plate 119*a*.

Figure 8:
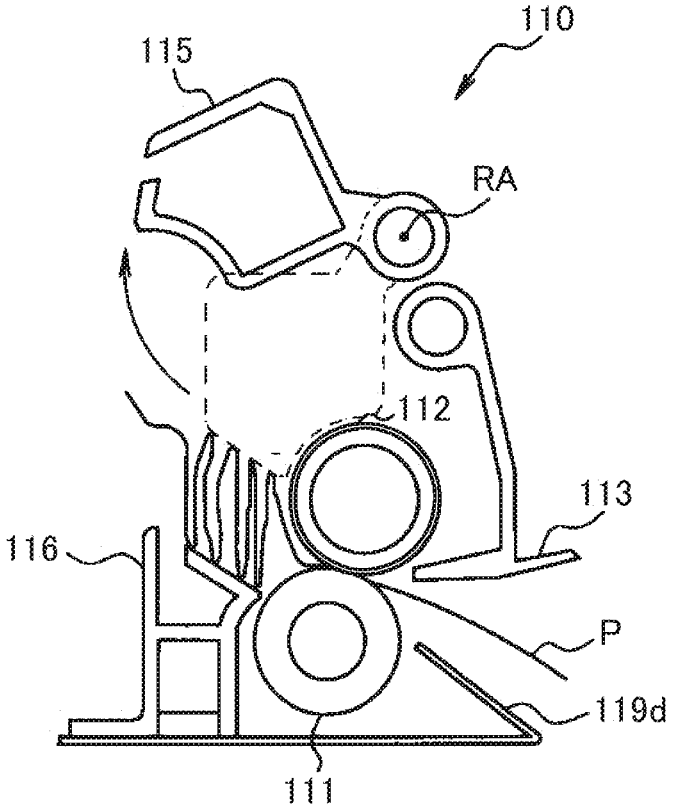
FIG. 8 is a diagram illustrating a state in which a jammed sheet in a sheet ejection passage is removed.

FIG. 8 is a diagram illustrating a state in which a jammed sheet in the sheet ejection passage 206 is removed.

When a paper jam occurs in the sheet ejection passage 206, the sheet conveying device 100 is moved slidably relative to the housing of the printing device 1 and pulled out from the housing of the printing device 1, as illustrated in FIG. 1. Then, a sheet ejection cover 260*a* (see FIG. 4) of the sheet ejection unit 260 is opened to expose the sheet ejection passage 206. Then, as illustrated in FIG. 8, the jammed sheet P jammed in the sheet ejection passage 206 is picked and pulled upward. At this time, the upper air duct 115 is rotated about an axis of rotation RA of the support 115*a* from the opposing position indicated by a broken line in FIG. 8, to the retracted position indicated by a solid line in FIG. 8, following movement of the jammed sheet P. With this rotational movement, the upper air duct 115 is restrained from interfering with movement of the jammed sheet P, and the jammed sheet P is easily removed.

When the jammed sheet P is removed from the sheet ejection passage 206, the upper air duct 115 is rotated in a counterclockwise direction in FIG. 8 by the biasing force of the front torsion spring 118*a* and the rear torsion spring 118*b*, and automatically returns to the opposing position indicated by the broken line in FIG. 8.

Next, a detailed description is given of the upper air duct 115.

Figure 9A:
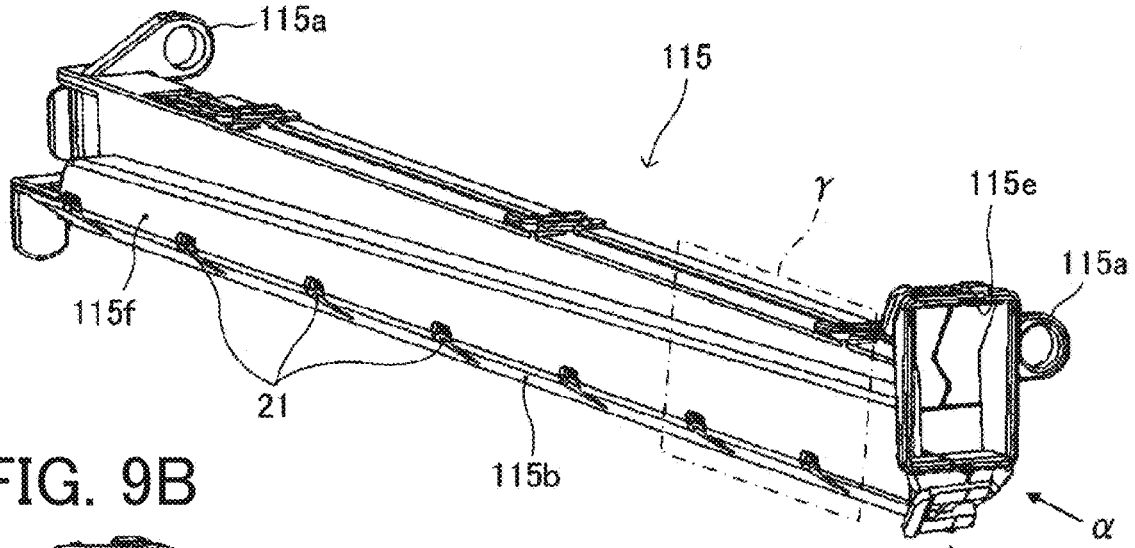
FIGS. 9A, 9B, and 9C are perspective views illustrating an upper air duct.
Figure 9B:
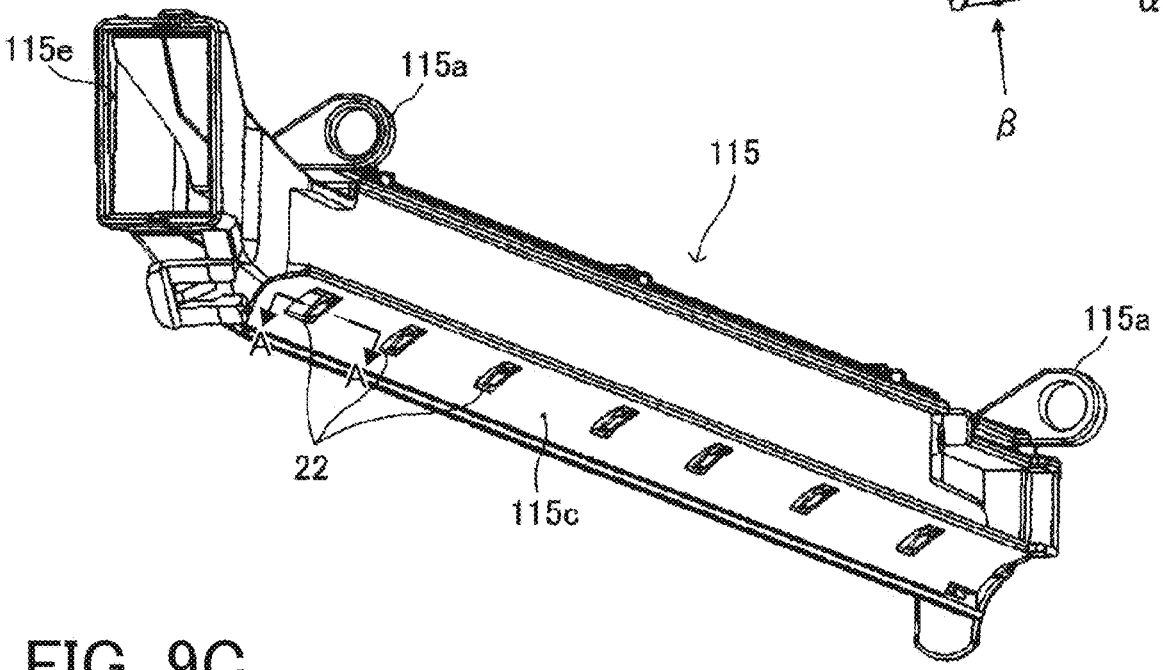
Figure 9C:
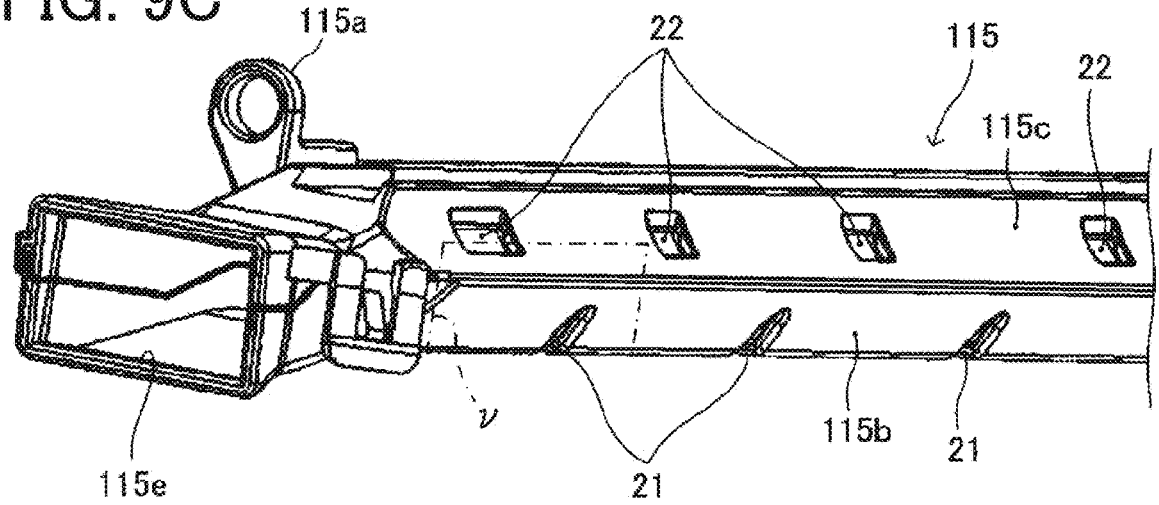

FIGS. 9A, 9B, and 9C are perspective views illustrating the upper air duct 115. Specifically, FIG. 9A is a perspective view illustrating the upper air duct 115. FIG. 9B is a diagram of the upper air duct 115, when viewed from a direction indicated by arrow α in FIG. 9A. FIG. 9C is a diagram illustrating the upper air duct 115, when viewed from a direction indicated by arrow β in FIG. 9A.

As illustrated in FIG. 9A, each of the plurality of upper conveyance passage blowout ports 21 is provided across the upper sheet guide face 115*b* and the downstream side wall 115*f*. Additionally, as illustrated in FIG. 9B, the upper air duct 115 has a roller opposing face 115*c* having an arc shape and facing the driven roller 112, and the plurality of roller blowout ports 22 as a plurality of second blowout ports are provided on the roller opposing face 115*c* at predetermined intervals in the sheet width direction.

Among the plurality of roller blowout ports 22, a roller blowout port 22 arranged on a side provided with an upper receiving port 115*e* (hereinafter, this roller blowout port 22 of the plurality of roller blowout ports 22 is occasionally referred to as an "extreme-upstream-side roller blowout port 22") has an opening area greater than an opening area of the rest of the plurality of roller blowout ports 22 (hereinafter, the rest of the plurality of roller blowout ports 22 are occasionally referred to as the "rest of the roller blowout ports 22"). The upper receiving port 115*e* receives the cooling air of the upper air duct 115 (on the extreme upstream side in the cooling air flow direction). The reason why the opening area of the extreme-upstream-side roller blowout port 22 is greater than the opening area of the rest of the roller blowout ports 22 is that, because the cooling air having entered the upper air duct 115 from the upper receiving port 115*e* flows quickly and strongly, the cooling air is hardly blown out from the extreme-upstream-side roller blowout port 22 on the extreme upstream side in the cooling air flow direction. Therefore, the opening area of the extreme-upstream-side roller blowout port 22 on the extreme upstream side in the cooling air flow direction is broadened so that the cooling air flows more easily in the extreme-upstream-side roller blowout port 22 than in the rest of the roller blowout ports 22, and respective flow rates of the cooling air blown out from the plurality of roller blowout ports 22 are equal. Consequently, the driven roller 112 is uniformly cooled in the axial direction.

Furthermore, as illustrated in FIG. 9C, the plurality of roller blowout ports 22 and the plurality of upper conveyance passage blowout ports 21 are provided alternately in the duct longitudinal direction (in other words, the cooling air flow direction). In a case in which each of the plurality of roller blowout ports 22 and each of the plurality of upper conveyance passage blowout ports 21 are provided at the same position in the duct longitudinal direction, the cooling air may be blown out in a one-sided manner from either the plurality of roller blowout ports 22 or the plurality of upper conveyance passage blowout ports 21, and the cooling air may not be blown out at a desired flow rate from the other blowout ports. However, in the case in which the plurality of roller blowout ports 22 and the plurality of upper conveyance passage blowout ports 21 are alternately provided in the duct longitudinal direction (in other words, the cooling air flow direction), similar to the present embodiment, significant decrease is restrained in both the flow rate of the cooling air blown from the plurality of roller blowout ports 22 and the flow rate of the cooling air blown from the plurality of upper conveyance passage blowout ports 21. Consequently, both the sheet P and the driven roller 112 are excellently cooled by the air.

Figure 10:
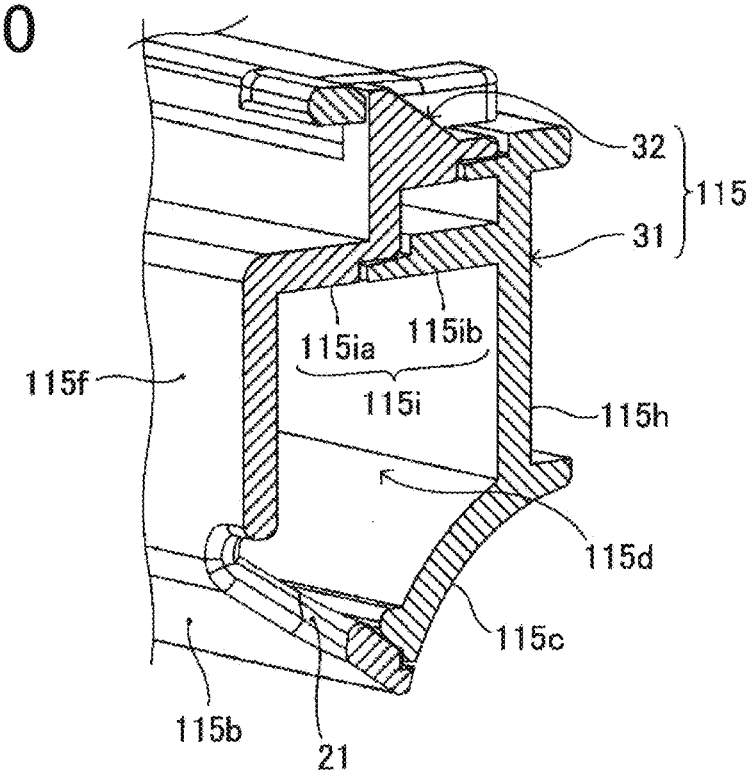
FIG. 10 is a cross-sectional perspective view illustrating the upper air duct.
Figure 11:
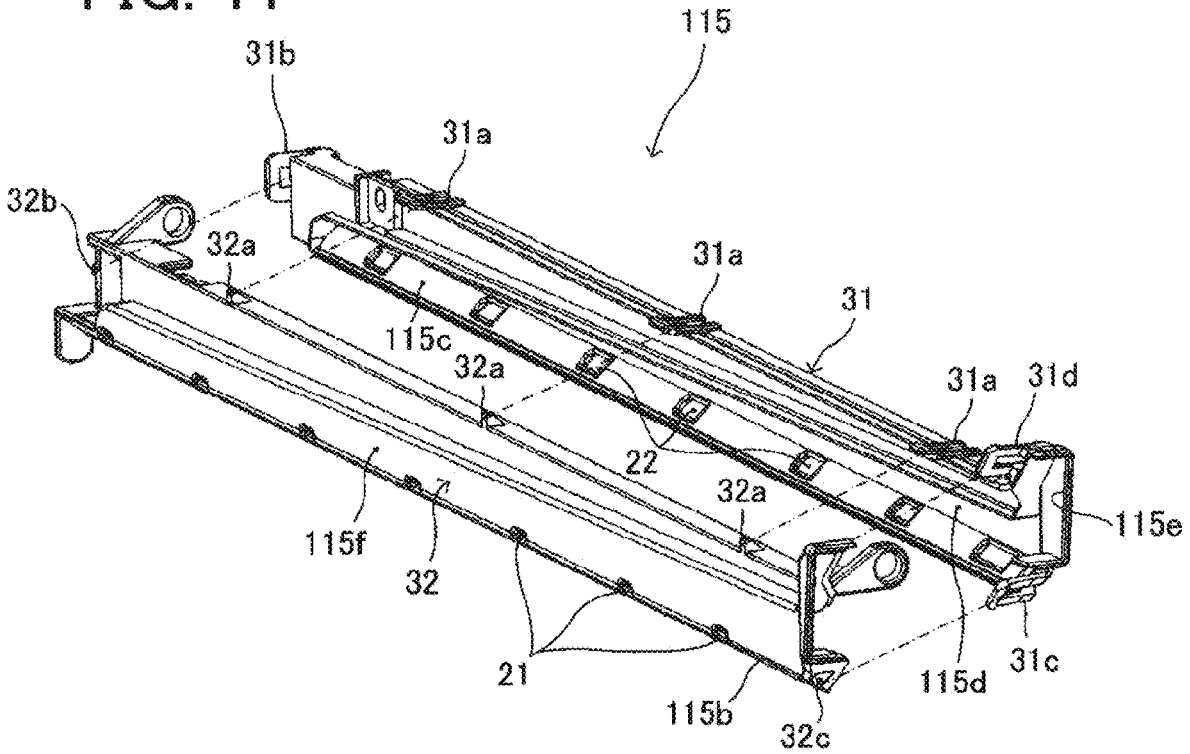
FIG. 11 is an exploded perspective view illustrating the upper air duct.

FIG. 10 is a cross-sectional perspective view illustrating the upper air duct 115. FIG. 11 is an exploded perspective view illustrating the upper air duct 115.

As illustrated in FIGS. 10 and 11, the upper air duct 115 includes a first upper member 31 and a second upper member 32. The first upper member 31 and the second upper member 32 are combined to form the upper air blowing passage 115*d* in which the cooling air flows. The first upper member 31 includes the roller opposing face 115*c*, an upstream side wall 115*h*, and a partial upper wall 115*ib* of an upper wall 115*i*. The roller opposing face 115*c* of the upper air duct 115 is disposed facing the driven roller 112. The second upper member 32 includes the upper sheet guide face 115*b*, the downstream side wall 115*f*, and a partial upper wall 115*ia* of the upper wall 115*i*.

Additionally, as illustrated in FIG. 11, three claws 32*a* are provided on the upper surface of the second upper member 32 at predetermined intervals in the duct longitudinal direction. Furthermore, the second upper member 32 has one end in the duct longitudinal direction (i.e., an end on the downstream side in the flow direction of the cooling air) provided with a claw 32*b* at one place. The second upper member 32 has the other end in the duct longitudinal direction (i.e., an end on the upstream side in the flow direction of the cooling air) also provided with a claw 32*c*. Moreover, the upper receiving port 115*e* has an upper portion provided with a claw 32*d* (see FIG. 12A).

The first upper member 31 is provided with hooks 31*a*, 31*b*, 31*c*, and 31*d* in a manner corresponding to the respective claws 32*a*, 32*b*, 32*c*, and 32*d* of the second upper member 32, as indicated by broken lines FIG. 11.

Figure 12A:
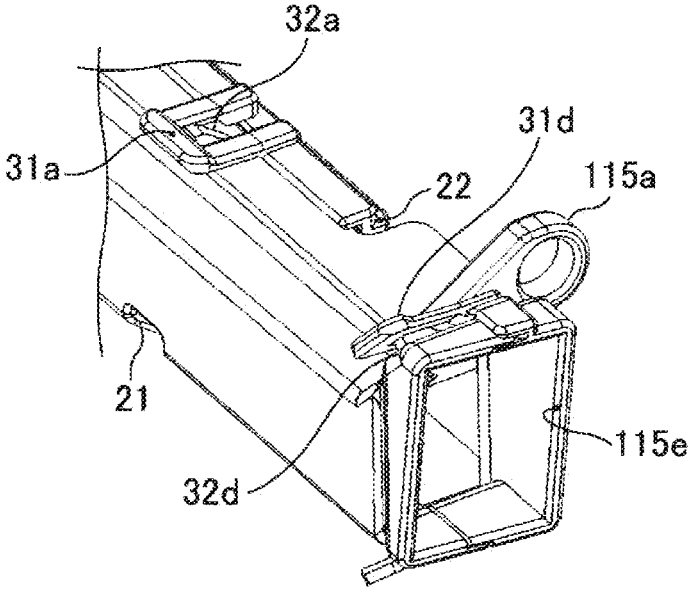
FIGS. 12A and 12B are diagrams explaining assembly of a first upper member and a second upper member.
Figure 12B:
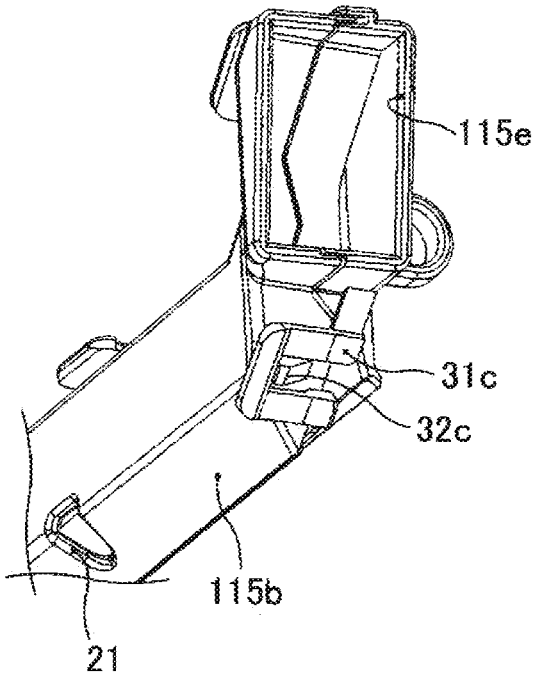

FIGS. 12A and 12B are diagrams explaining assembly of the first upper member 31 and the second upper member 32.

As illustrated in FIGS. 12A and 12B, the first upper member 31 and the second upper member 32 are assembled to compose the upper air duct 115 by snap-fitting in which the hooks of the first upper member 31 are elastically deformed to fit the claws of the second upper member 32 into the hooks. Thus, in the present embodiment, the upper air duct 115 is easily built by assembling the first upper member 31 and the second upper member 32 by the snap-fitting.

Figure 13A:
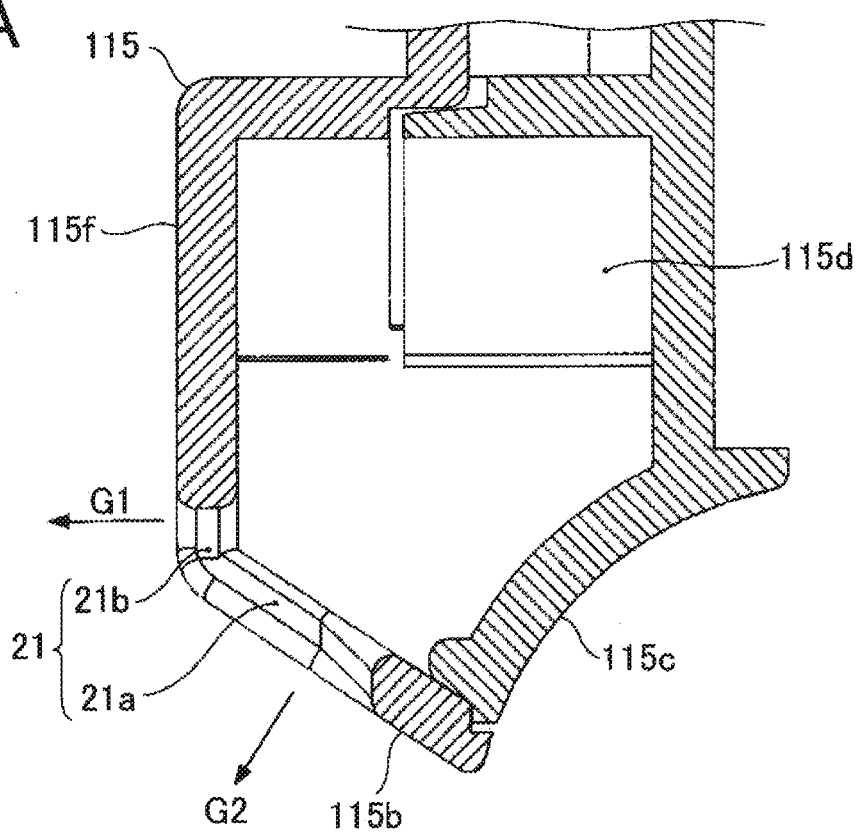
FIGS. 13A and 13B are diagrams explaining details of an upper conveyance passage blowout port of the upper air duct.
Figure 13B:
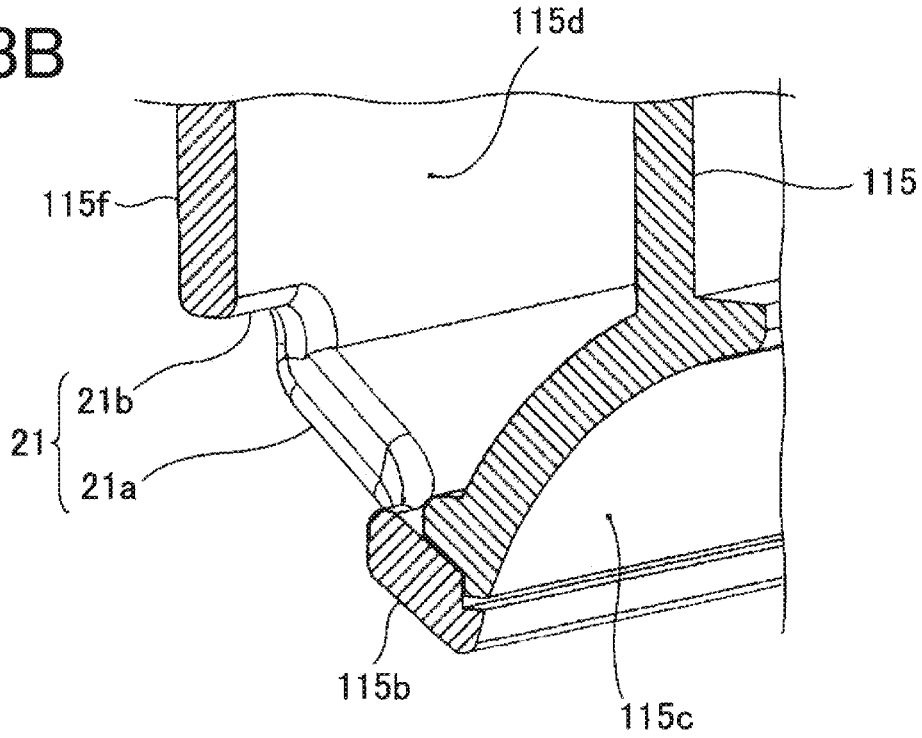

FIGS. 13A and 13B are diagrams explaining details oft the plurality of upper conveyance passage blowout ports 21 of the upper air duct 115. It is to be noted that the plurality of upper conveyance passage blowout ports 21 is occasionally referred to in a singular form, for convenience.

As illustrated in FIGS. 13A and 13B, each of the plurality of upper conveyance passage blowout ports 21 (in other words, the upper conveyance passage blowout port 21) includes an upper first opening 21*a* and an upper second opening 21*b*. The upper first opening 21*a* functions as a first blowout port provided on the upper sheet guide face 115*b*. The upper second opening 21*b* functions as a third blowout port provided on the downstream side wall 115*f*.

The cooling air is blown out from the upper first opening 21*a* of the upper conveyance passage blowout port 21 toward the lower air duct 116 in a direction indicated by arrow G2 in FIG. 13A. Similarly, the cooling air is blown out from the upper second opening 21*b* to the sheet ejection unit 260 in a direction indicated by arrow G1 in FIG. 13A.

Consequently, as described above, the cooling air is blown to a broad range of the upper surface of the sheet P, the upper surface of the sheet P is excellently cooled, and the sheet ejection unit 260 is cooled by the air.

It is to be noted that, in the present embodiment, the upper first opening 21*a* and the upper second opening 21*b* are connected to each other. However, the configuration of the upper conveyance passage blowout port 21 is not limited to the above-described configuration. For example, the upper first opening 21*a* and the upper second opening 21*b* may be provided separately. Even with this configuration, the cooling air is blown in the direction G2 and the direction G1 and the cooling air is blown to the broad range of the upper surface of the sheet P. Thus, the sheet P is excellently cooled and the sheet ejection unit 260 is also cooled by the air.

However, since the upper first opening 21*a* and the upper second opening 21*b* are connected to each other, the end on the downstream side in the sheet conveyance direction of the upper conveyance passage blowout port 21 is provided at a position more retracted from the sheet ejection passage 206 than the upper sheet guide face 115*b* is. Consequently, as described above, the leading end of the sheet P is restrained from being caught at the end on the downstream side in the sheet conveyance direction of the upper conveyance passage blowout port 21, and occurrence of sheet edge folding error or occurrence of sheet jamming error is restrained.

Figure 14:
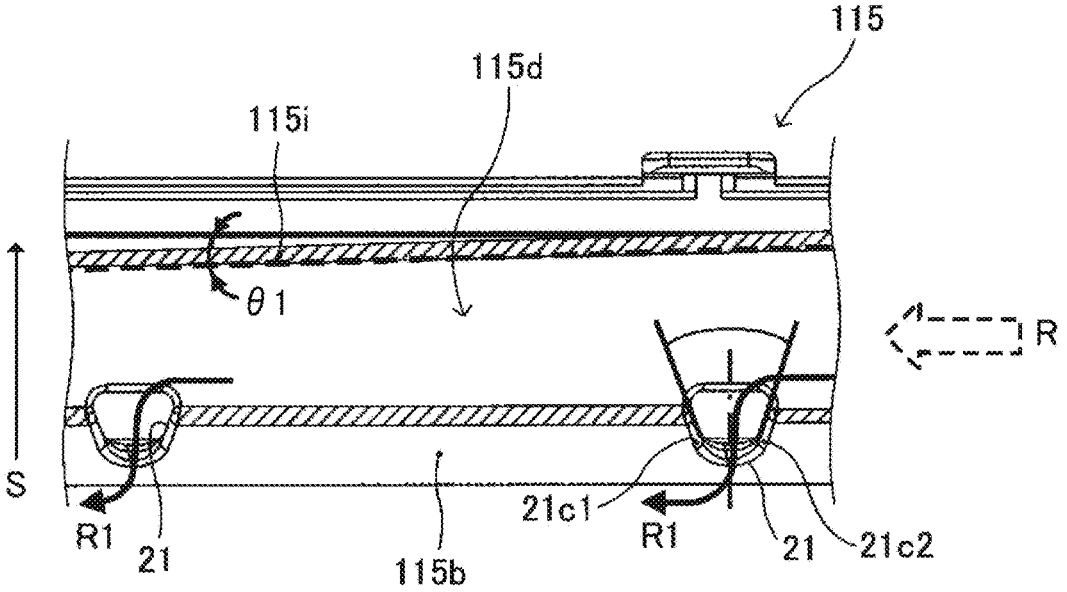
FIG. 14 is a cross-sectional view illustrating the upper air duct, along a line γ in FIG. 9A.

FIG. 14 is a cross-sectional view illustrating the upper air duct 115, along a line yin FIG. 9A.

As illustrated in FIG. 14, the upper wall 115*i* of the upper air duct 115 is gradually inclined in a manner approaching (descending) to the upper sheet guide face 115*b* (at an angle θ1 relative to a horizontal direction indicated by a solid line in FIG. 14) toward the downstream side in the flow direction of the cooling air. With this configuration, the cross-sectional area of the upper air blowing passage 115*d* is gradually reduced from the upstream side toward the downstream side in the flow direction of the cooling air.

The cooling air of the upper air blowing passage 115*d* is blown out from the plurality of upper conveyance passage blowout ports 21 and the plurality of roller blowout ports 22, which are located on the upstream side in the flow direction of the cooling air (in other words, a direction indicated by arrow R in FIG. 14). Consequently, the flow rate of the cooling air is gradually decreased toward the downstream side in the flow direction R. However, since the cross-sectional area of the upper air blowing passage 115*d* is gradually reduced toward the downstream side, a decrease in a flow speed caused by the decrease in the flow rate is prevented. Consequently, the flow rate of the cooling air per unit time is restrained from decreasing when the cooling air is blown out from the downstream side in the flow direction of the cooling air through the plurality of upper conveyance passage blowout ports 21 and the plurality of roller blowout ports 22. Thus, the cooling air is blown out equally from the respective blowout ports, and a sheet P and the driven roller 112 are equally cooled by the air in the sheet width direction. Furthermore, since the flow speed of the cooling air is restrained from decreasing, even in a case in which the plurality of upper conveyance passage blowout ports 21 has the same shape, the cooling air is blown out from the respective upper conveyance passage blowout ports 21 at the uniform (same) flow speed on the upstream side and the downstream side in the flow direction of the cooling air.

In a case in which the upper sheet guide face 115*b* or the roller opposing face 115*c* is inclined so as to gradually reduce the cross-sectional area of the upper air blowing passage 115*d*, a distance from a cooling object (for example, the sheet P or the driven roller 112) becomes different between the upstream side and the downstream side in the flow direction, and therefore it is likely that the cooling object is not equally cooled in the sheet width direction. Additionally, it is also conceivable to gradually increase a thickness of the upper sheet guide face 115*b* or a thickness of the roller opposing face 115*c* toward the downstream side in the flow direction to incline an upper surface of the upper sheet guide face 115*b* or an upper surface of the roller opposing face 115*c*, so that the cross-sectional area of the upper air blowing passage 115*d* is gradually reduced. However, the first upper member 31 and the second upper member 32 composing the upper air duct 115 are molded products of a resin. Therefore, in a case in which the thickness of the upper sheet guide face 115*b* or the thickness of the roller opposing face 115*c* is changed, failure such as sinking occurs, and the upper sheet guide face 115*b* and the roller opposing face 115*c* may come to have uneven surfaces. As a result, the cooling air is not blown out in a desired direction from the air blowout ports provided on the upper sheet guide face 115*b* and the roller opposing face 115*c*, and uneven cooling may be performed.

On the other hand, it is preferable to incline the upper wall 115*i* of the upper air duct 115 because no problem occurs in the above-described cooling air blowing. Additionally, in the present embodiment, the upper wall 115*i* is inclined so that the cross-sectional area of the upper air blowing passage 115*d* is gradually reduced toward the downstream side in the flow direction of the cooling air. However, the thickness of the upper wall 115*i* may be gradually increased toward the downstream in the flow direction of the cooling air so as to incline the upper surface of the upper air blowing passage 115*d*.

Additionally, the upstream side wall 115*h* may be inclined to incline the side wall surface on the upstream side of the upper air blowing passage 115*d* in the sheet conveyance direction so that the cross-sectional area of the upper air blowing passage 115*d* is gradually reduced toward the downstream side in the flow direction of the cooling air.

Furthermore, as illustrated in FIG. 14, the upper conveyance passage blowout port 21 has a shape in which an axial width is gradually increased toward the downstream side in the sheet conveyance direction (indicated by arrow S in FIG. 14), and in which edges 21*c*1 and 21*c*2 of the upper conveyance passage blowout port 21 extending in the sheet conveyance direction are inclined. Since the edge 21*c*1 on one side and the edge 21*c*2 on the other side of the upper conveyance passage blowout port 21 are thus inclined so as to be gradually separated from each other in the axial direction toward the downstream side in the sheet conveyance direction (i.e., the direction S in FIG. 14), corners of the sheet P are prevented from being caught at the edge 21*c*1 or the edge 21*c*2. Consequently, occurrence of sheet edge folding error is prevented. Furthermore, since the edge 21*c*1 on one side and the edge 21*c*2 on the other side of the upper conveyance passage blowout port 21 are inclined, an image on the sheet P is hardly caught at the edges 21*c*1 and 21*c*2 when the image on the sheet P contacts on the edges 21*c*1 and 21*c*2, and streaks is prevented from being formed on the image.

Additionally, in the present embodiment, an exhaust port that exhausts the air flowing inside from the image forming apparatus 1000 is provided on the rear side of the housing of the image forming apparatus 1000 (on the downstream side in the flow direction of the cooling air inside the upper air blowing passage 115*d*). Therefore, a part of the cooling air blown out from the plurality of upper conveyance passage blowout ports 21 flows to the rear side of the image forming apparatus 1000 as indicated by arrow R1 in FIG. 14. Consequently, the cooling air is brought into contact with a portion not facing any one of upper conveyance passage blowout ports 21 among the plurality of upper conveyance passage blowout ports 21 in the sheet width direction. As a result, the upper surface of the sheet P is uniformly cooled in the sheet width direction.

Figure 15:
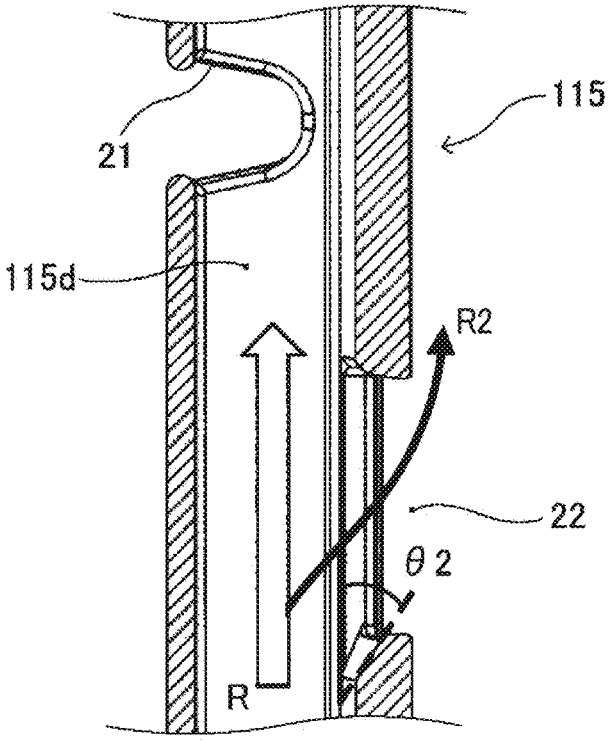
FIG. 15 is a cross-sectional view illustrating the upper air duct, along a line ν in FIG. 9C.

FIG. 15 is a cross-sectional view illustrating the upper air duct 115, along a line v in FIG. 9C.

Each of the plurality of roller blowout ports 22 (hereinafter, occasionally referred to in a singular form as the roller blowout port 22) includes an inclined surface on an end surface on the upstream side in the flow direction of the cooling air inside the upper air blowing passage 115*d*. The inclined surface is inclined outward from the upper air blowing passage 115*d* so that the end surface of the roller blowout port 22 is located on the downstream side in the flow direction of the cooling air inside the upper air blowing passage 115*d*. (In other words, the inclined surface is inclined outward at an angle θ2 relative to the flow direction of the cooling air inside the upper air blowing passage 115*d*.) With this configuration, pressure loss of the cooling air that is blown out from each of the roller blowout ports 22 is reduced, and degradation in blowout efficiency is prevented.

As described above, since the exhaust port is further provided on the rear side of the housing of the image forming apparatus 1000, part of the cooling air blown out from each of the plurality of roller blowout ports 22 flows to the rear side of the image forming apparatus 1000 as indicated by arrow R2 in FIG. 15. Consequently, the cooling air is brought into contact with a portion not facing any one of the plurality of roller blowout ports 22 in the axial direction of the driven roller 112. As a result, the driven roller 112 is equally cooled in the axial direction.

Next, a detailed description is given of the lower air duct 116.

Figure 16A:
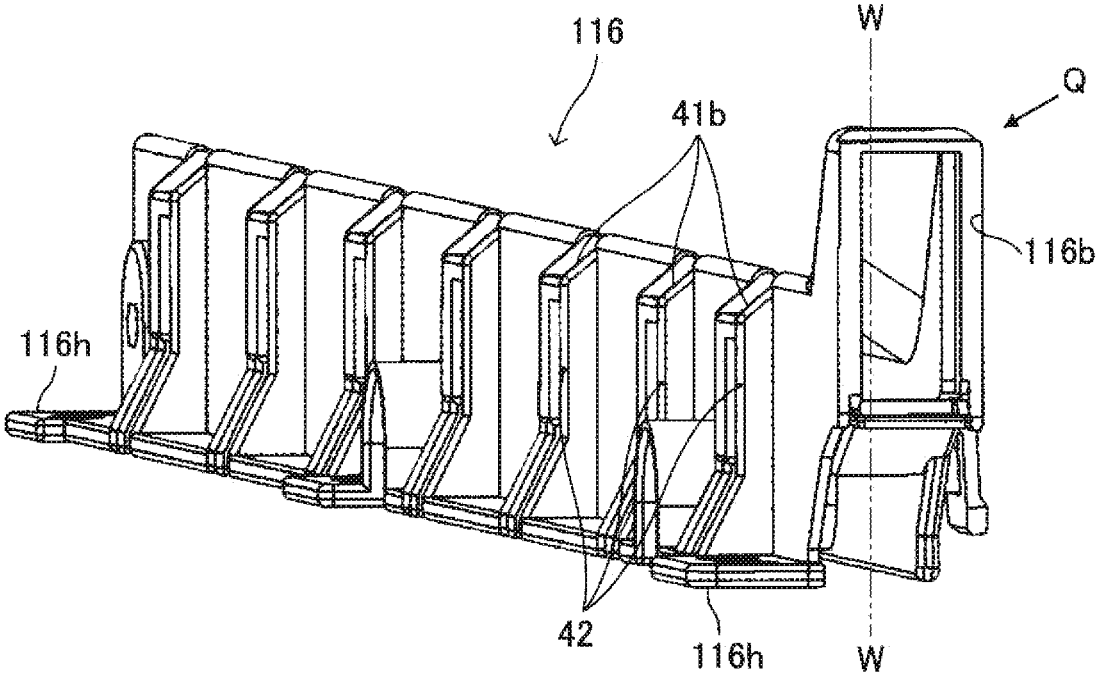
FIG. 16A is a perspective view illustrating a lower air duct.
Figure 16B:
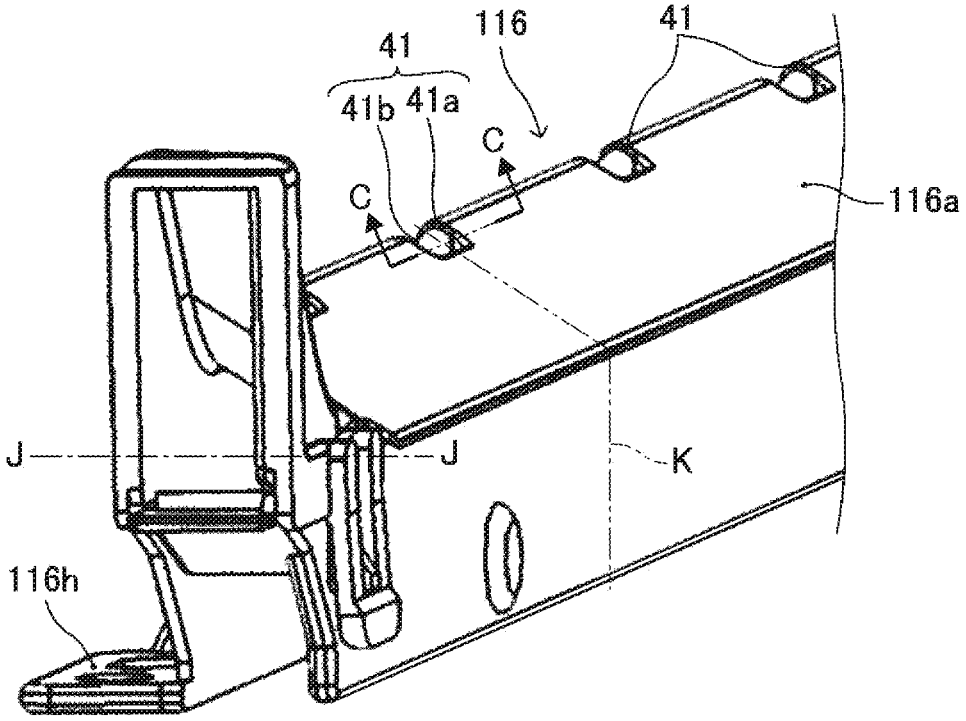
FIG. 16B is an enlarged perspective view illustrating a main part of the lower air duct, viewed from a direction Q in FIG. 16A.

FIG. 16A is a perspective view illustrating the lower air duct 116. FIG. 16B is an enlarged perspective view illustrating a main part of the lower air duct 116, viewed from a direction Q in FIG. 16A.

As illustrated in FIG. 16A, the lower air duct 116 is provided with a plurality of exhaust devices 42 at predetermined intervals in the duct longitudinal direction (i.e., the axial direction, the sheet width direction, the front-rear direction of the apparatus, and the flow direction of the cooling air). Each of the plurality of exhaust devices 42 (hereinafter, occasionally referred to in a singular form as the exhaust device 42) extends to the downstream side in the sheet conveyance direction. The exhaust device 42 is used to exhaust, from each of the plurality of lower conveyance passage blowout ports 41, the cooling air inside the lower air duct 116. Additionally, front and rear ends on the downstream side of the lower air duct 116 in the sheet conveyance direction are provided with fastening targets 116*h* to be fastened to the sheet metal frame 119.

Furthermore, the front end of the lower air duct 116 is provided with a lower receiving port 116*b* that communicates with the second communicating portion 123*c* of the communication pipe 123 (see FIG. 5) to receive the cooling air from the second communicating portion 123*c*.

Additionally, as illustrated in FIGS. 16A and 16B, the plurality of lower conveyance passage blowout ports 41 is provided at predetermined intervals in the duct longitudinal direction. Each of the plurality of lower conveyance passage blowout ports 41 (hereinafter, occasionally referred to in a singular form as the lower conveyance passage blowout ports 41) includes a lower first opening 41*a* and a lower second opening 41*b*. The lower first opening 41*a* functions as a fourth blowing port provided on the downstream side of the lower sheet guide face 116*a* in the sheet conveyance direction. The lower second opening 41*b* functions as a fifth blowing port provided at an upper end of the exhaust device 42.

The lower sheet guide face 116*a* is inclined so as to be located at a position gradually rising up toward the downstream side in the sheet conveyance direction (in other words, the lower sheet guide face 116*a* is inclined upward relative to the sheet conveyance direction) while an upper surface of each of the plurality of exhaust devices 42 is inclined so as to be located at a position gradually lowering down toward the downstream side in the sheet conveyance direction (in other words, the upper surface of each of the plurality of exhaust devices 42 is inclined downward relative to the sheet conveyance direction).

Figure 17:
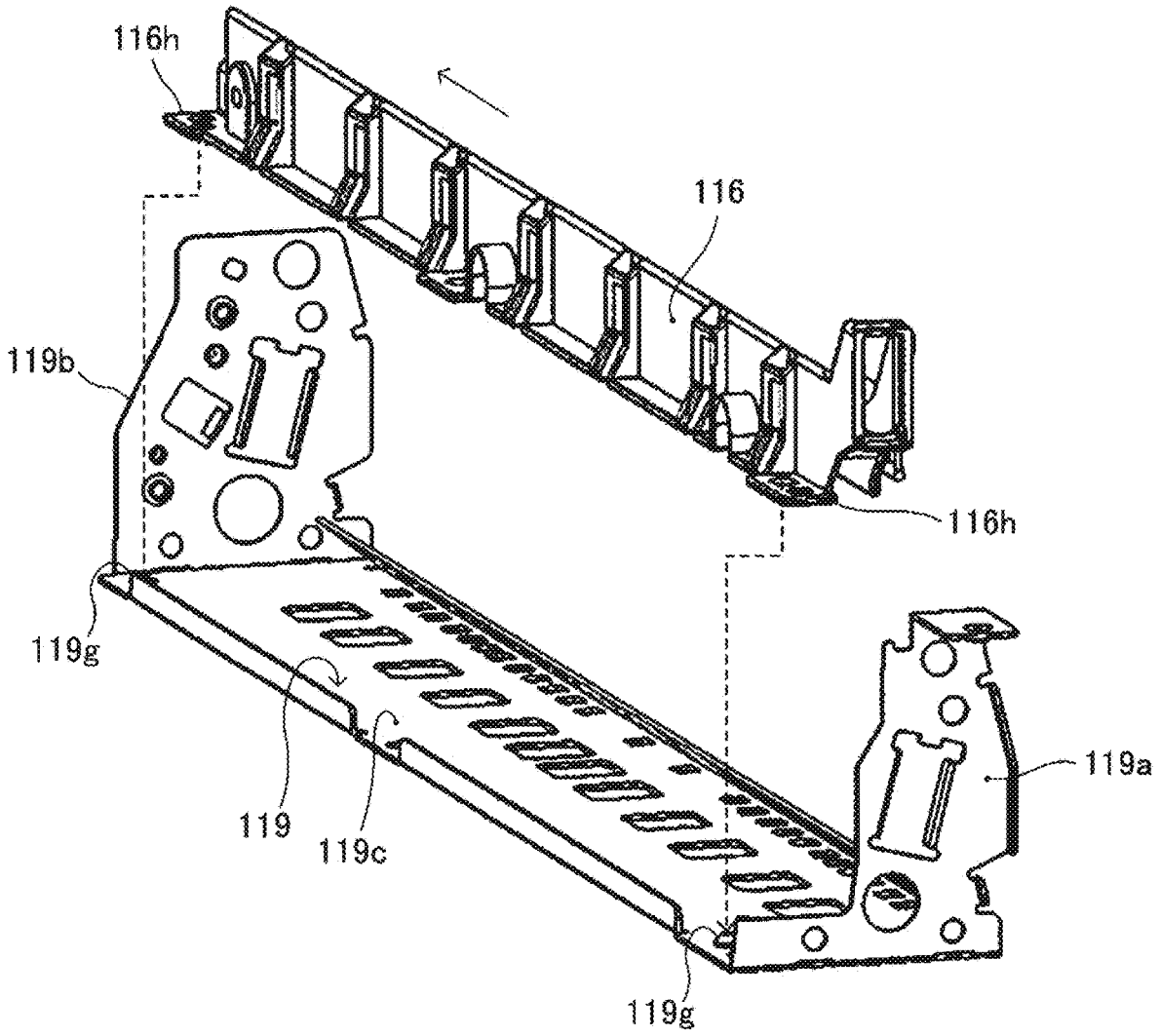
FIG. 17 is a perspective view illustrating the lower air duct and a sheet metal frame.

FIG. 17 is a perspective view illustrating the lower air duct 116 and the sheet metal frame 119.

As illustrated in FIG. 17, the sheet metal frame 119 includes screw holes 119*g*, each having a thread groove formed on an inner circumferential surface of the screw holes 119*g*. The screw holes 119*g* are disposed near each of both ends of the bottom plate 119*c* of the sheet metal frame 119, in the front-rear direction on the downstream side of the sheet conveyance (i.e., the left side in FIG. 17).

Each of the fastening targets 116*h* of the lower air duct 116 is provided with a screw through hole into which a screw is inserted. The screw is screwed into a screw hole 119*g* to fasten the lower air duct 116 to the sheet metal frame 119.

Figure 18A:
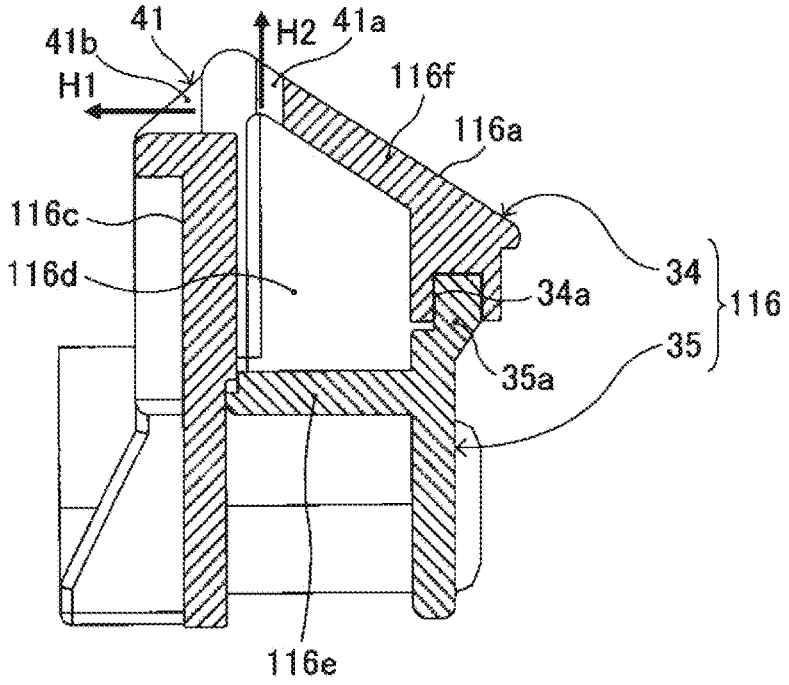
FIG. 18A is a cross-sectional view illustrating the lower air duct, along a line K in FIG. 16B.
Figure 18B:
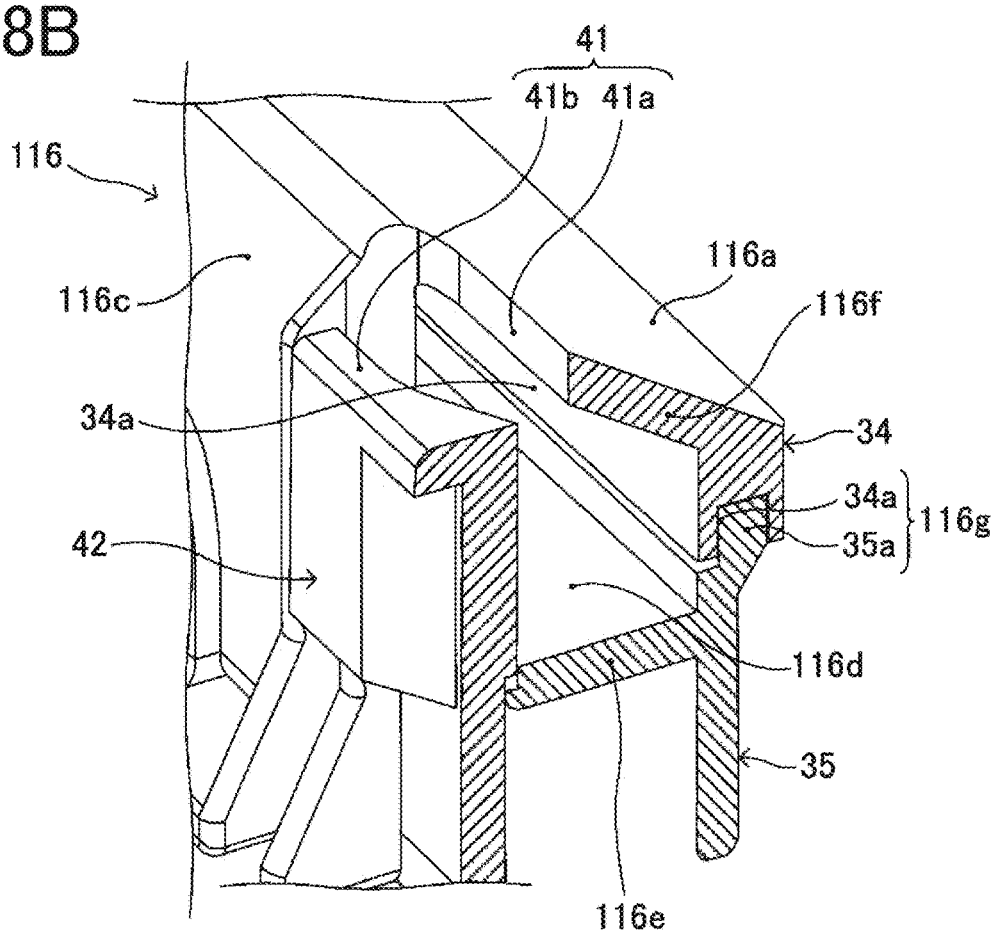
FIG. 18B is a cross-sectional perspective view illustrating the lower air duct, along the line K in FIG. 16B.

FIG. 18A is a cross-sectional view illustrating the lower air duct 116, along a line K in FIG. 16B. FIG. 18B is a cross-sectional perspective view illustrating the lower air duct 116, along the line K in FIG. 16B.

As illustrated in FIGS. 18A and 18B, the lower air duct 116 includes a first lower member 34 including a resin and a second lower member 35 including a resin. The first lower member 34 includes an upper wall 116*f* of the lower air blowing passage 116*d* and the downstream side wall 116*c* of the lower air blowing passage 116*d*. The second lower member 35 includes a lower wall 116*e* of the lower air blowing passage 116*d*. Additionally, the second lower member 35 includes a protrusion 35*a* provided at an upstream end of the lower wall 116*e* in the sheet conveyance direction and extending upward. On the other hand, the first lower member 34 includes a groove 34*a* provided at an upstream end of the upper wall 116*f* in the sheet conveyance direction and extending downward. The groove 34*a* is used to fit into the protrusion 35*a*. The protrusion 35*a* is fitted into the groove 34*a* to form an upstream side wall 116*g* on the upstream side of the lower air blowing passage 116*d* in the sheet conveyance direction.

The first lower member 34 and the second lower member 35 are assembled by the snap-fitting to form the lower air duct 116 inside which the lower air blowing passage 116*d* is formed.

Each of the plurality of lower conveyance passage blowout ports 41 includes the lower first opening 41*a* and the lower second opening 41*b*. The lower first opening 41*a* functions as a fourth blowing port provided on the lower sheet guide face 116*a*. The lower second opening 41*b* functions as a fifth blowing port provided on the upper surface of each of the plurality of exhaust devices 42.

Thus, since the lower second opening 41*b* is provided in each of the plurality of exhaust devices 42 extending to the downstream side in the sheet conveyance direction from the downstream end of the lower sheet guide face 116*a* in the sheet conveyance direction, each of the plurality of lower conveyance passage blowout ports 41 extends to the downstream side in the sheet conveyance direction and blows the cooling air to a broad range of the lower surface of the sheet P. Consequently, the sheet P is excellently cooled.

Additionally, the lower second opening 41*b* is inclined so as to be located gradually lower toward the downstream side in the sheet conveyance direction. With this configuration, the cooling air is blown out toward the upper air duct 115 from the lower first opening 41*a* of each of the plurality of lower conveyance passage blowout ports 41 in a direction indicated by arrow H2 in FIG. 18A, and the cooling air is blown out toward the sheet ejection unit 260 from the lower second opening 41*b* in a direction indicated by arrow H1 in FIG. 18A. Consequently, as described above, the cooling air is blown to the lower surface of the sheet P, the sheet P is excellently cooled, and the sheet ejection unit 260 is cooled by the air.

It is to be noted that, in the present embodiment, the lower first opening 41*a* and the lower second opening 41*b* are connected to each other. However, the configuration of the lower air duct 116 is not limited to the above-described configuration. For example, the lower first opening 41*a* and the lower second opening 41*b* may be provided separately. Even with this configuration, the cooling air is blown in the direction indicated by the arrow H2 and the direction indicated by arrow H1, and the lower surface of the sheet P and the sheet ejection unit 260 are cooled by the air.

However, since the lower first opening 41*a* and the lower second opening 41*b* are connected to each other, the downstream end of each blowout port in the sheet conveyance direction is provided at a position more retracted from the sheet ejection passage 206 than the downstream end of the lower sheet guide face 116*a* is. Consequently, as described above, the leading end of the sheet P is restrained from being caught at the downstream end of the blowout port in the sheet conveyance direction, and occurrence of sheet edge folding error or occurrence of sheet jamming error is prevented.

Figure 19:
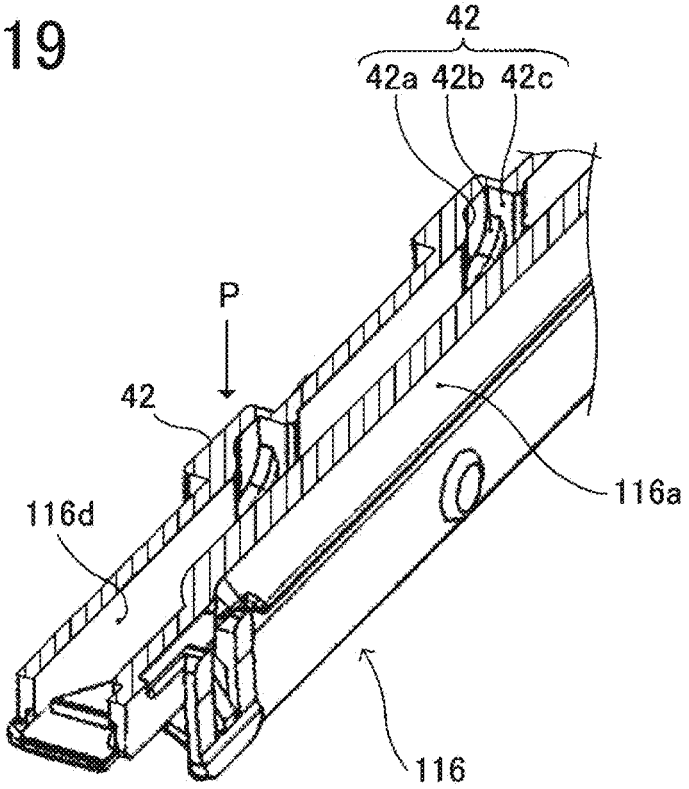
FIG. 19 is a cross-sectional view illustrating the lower air duct, along a line J-J in FIG. 16B.

FIG. 19 is a cross-sectional view illustrating the lower air duct 116, along a line J-J in FIG. 16B.

As illustrated in FIG. 19, each of the plurality of exhaust devices 42 includes a wall 42*c* orthogonal to the duct longitudinal direction. A part of the wall 42*c* protrudes toward the lower air blowing passage 116*d*. Part of the cooling air flowing inside the lower air blowing passage 116*d* is blocked by the wall 42*c*, and the blocked cooling air is blown out from each of the plurality of lower conveyance passage blowout ports 41 located above the lower air blowing passage 116*d*. Additionally, the exhaust device 42 includes a first inclined portion 42*a* and a second inclined portion 42*b*. The first inclined portion 42*a* of the exhaust device 42 is disposed more on an upstream side in the air flow direction than the wall 42*c* inside the lower air blowing passage 116*d*, and inclined in the duct longitudinal direction.

Figure 20:
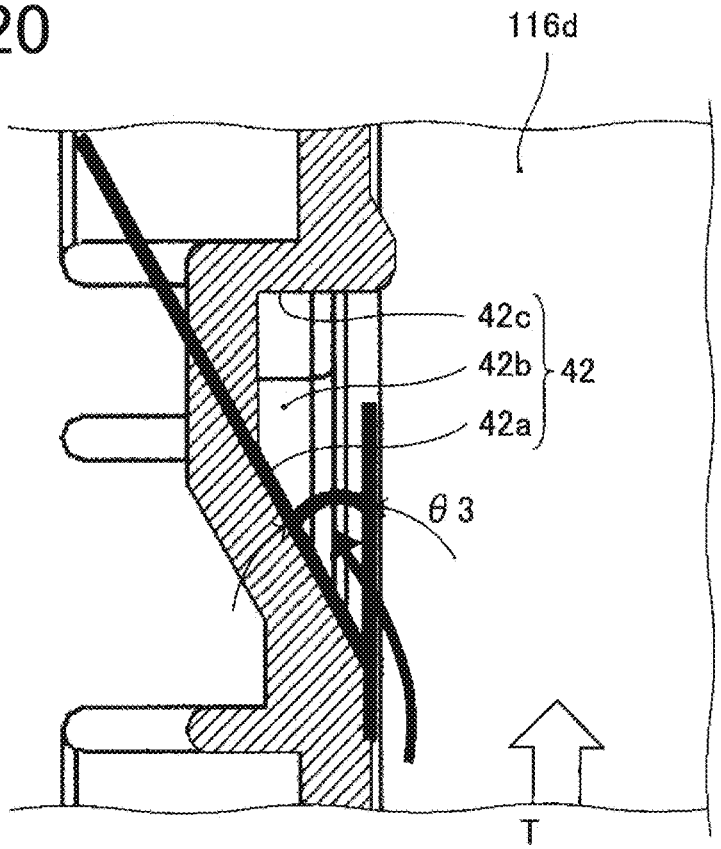
FIG. 20 is a diagram illustrating the lower air duct, viewed from a direction P in FIG. 19.

FIG. 20 is a diagram illustrating the lower air duct 116, viewed from a direction Pin FIG. 19.

The first inclined portion 42*a* is inclined to the downstream side in the sheet conveyance direction at an inclination angle θ3 relative to the wall surface parallel to the longitudinal direction of the lower air blowing passage 116*d*. Since the first inclined portion 42*a* is provided, pressure loss of the cooling air that has flown into the exhaust device 42 is restrained, and the flow speed of the cooling air is prevented from decreasing.

Consequently, decrease in momentum to blow out the cooling air from each of the plurality of lower conveyance passage blowout ports 41 is prevented.

Figure 21A:
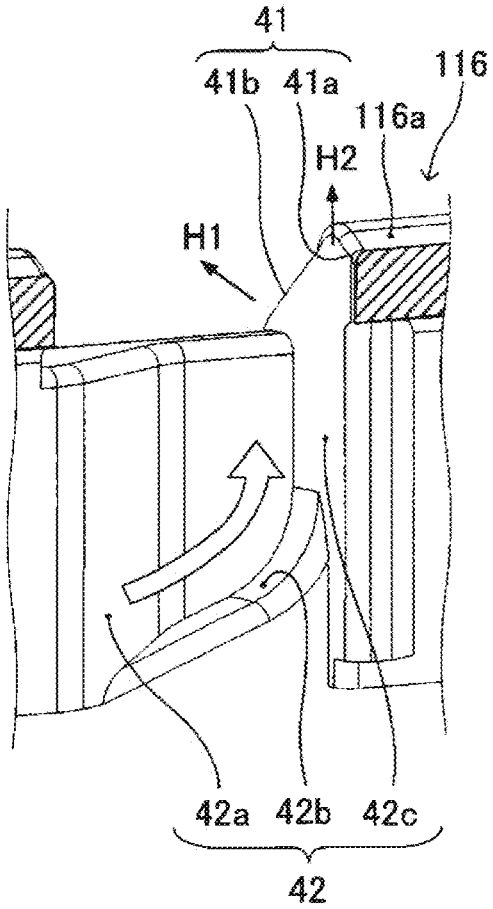
FIGS. 21A and 21B are cross-sectional views of the lower air duct, along a line C-C in FIG. 16B.
Figure 21B:
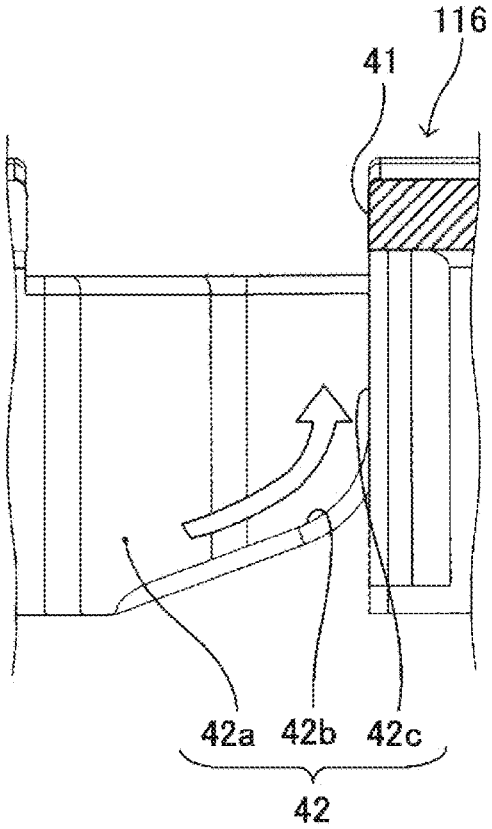

FIGS. 21A and 21B are cross-sectional views of the lower air duct 116, along a line C-C in FIG. 16B. To be more specific, FIG. 21A is a cross-sectional perspective view of the lower air duct 116, and FIG. 21B is a front cross-sectional view of the lower air duct 116.

As illustrated in FIGS. 21A and 21B, the second inclined portion 42*b* has a height that gradually rises toward the downstream side in the flow direction of the cooling air inside the lower air blowing passage 116*d* from a lower surface of the lower air blowing passage 116*d*. The inclination continues to the wall 42*c*. The second inclined portion 42*b* has an arc shape in the present embodiment. With this configuration, the cooling air that has flown into the exhaust device 42 is guided upward by the second inclined portion 42*b* as indicated by an arrow illustrated in FIGS. 21A and 21B. Consequently, pressure loss of the cooling air is restrained, and a decrease in the momentum to blow out the cooling air from the lower conveyance passage blowout ports 41 provided at the upper portion of the exhaust device 42 is prevented from decreasing.

Figure 22:
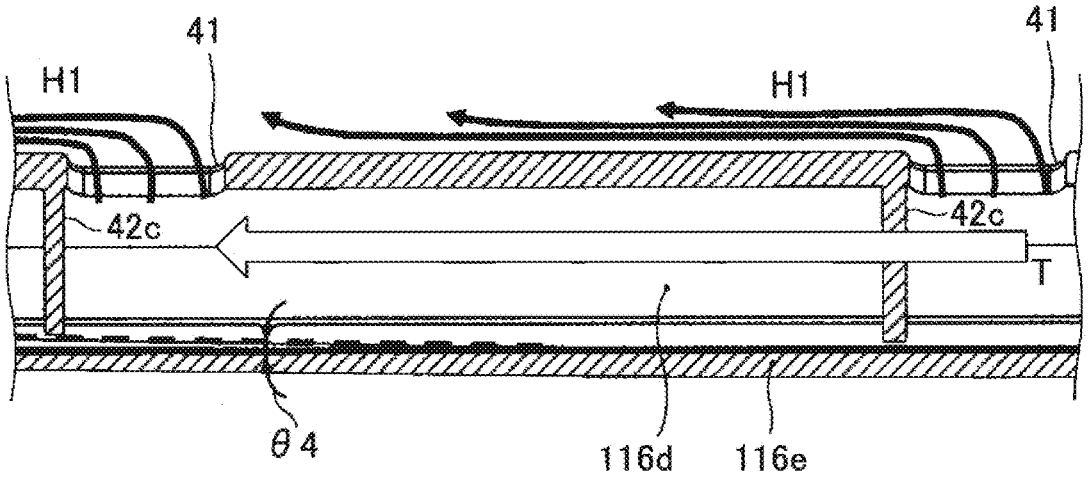
FIG. 22 is a cross-sectional view illustrating a part of the lower air duct, along a line W-W in FIG. 16A.

FIG. 22 is a cross-sectional view illustrating a part of the lower air duct 116, along a line W-W in FIG. 16A.

The lower wall 116*e* that forms a lower surface of the lower air blowing passage 116*d* is gradually inclined in a manner approaching (ascending) to the lower sheet guide face 116*a* toward the downstream side from a certain point of the cooling air in the flow direction. (In other words, the lower wall 116*e* has an inclination inclined at an angle θ4 relative to the horizontal direction indicated by a solid line in FIG. 22.) With this configuration, the cross-sectional area of the lower air blowing passage 116*d* is gradually reduced.

Consequently, the cooling air of the lower air blowing passage 116*d* is blown out from the plurality of lower conveyance passage blowout ports 41 located on the upstream side in the flow direction of the cooling air (i.e., a direction indicated by arrow T in FIG. 22), thereby gradually decreasing the flow rate of the cooling air toward the downstream side in the flow direction T. However, since the cross-sectional area of the lower air blowing passage 116*d* is gradually reduced toward the downstream side, the flow speed caused by the decrease in the flow rate is restrained from decreasing. Consequently, the flow rate of the cooling air per unit time is prevented from decreasing when the cooling air is blown out from the plurality of lower conveyance passage blowout ports 41 located on the downstream side. Accordingly, the cooling air is blown out equally from the plurality of lower conveyance passage blowout ports 41, and the lower surface of the sheet P is uniformly cooled by the air in the sheet width direction (i.e., the axial direction). Furthermore, since the decrease in the flow speed is restrained, even in a case in which the plurality of lower conveyance passage blowout ports 41 has the same shape, the cooling air is blown out from the plurality of lower conveyance passage blowout ports 41 at the equal flow speed on the upstream side and the downstream side in the flow direction of the cooling air.

Different from the upper air blowing passage 115*d*, the inclination of the lower air blowing passage 116*d* to reduce the cross-sectional area is started from a certain halfway point of the lower air blowing passage 116*d*, and the inclination angle of the lower air blowing passage 116*d* is also smaller than the inclination angle of the upper air blowing passage 115*d*. The reason why the inclination of the lower air blowing passage 116*d* is started from a certain halfway point of the lower air blowing passage 116*d* and the inclination angle of the lower air blowing passage 116*d* is smaller than the inclination angle of the upper air blowing passage 115*d* is that the lower air duct 116 blows the air from the plurality of lower conveyance passage blowout ports 41 alone and the decrease in the flow rate inside the lower air duct 116 is smaller than the decrease in the flow rate inside the upper air duct 115 in which the cooling air is blown from the upper conveyance passage blowout ports 21 and the roller blowout ports 22. Therefore, even if the inclination to reduce the cross-sectional area is started from the halfway point of the lower air blowing passage 116*d* and the inclination angle of the lower air blowing passage 116*d* is also smaller than the inclination angle of the upper air blowing passage 115*d*, the cooling air is blown out evenly from the plurality of lower conveyance passage blowout ports 41.

Similar to the upper air blowing passage 115*d*, it is preferable that the inclination of the lower air blowing passage 116*d* of the lower air duct 116 to reduce the cross-sectional area is not provided in a wall including a blowout port in order to prevent the problem caused in blowing out the cooling air. Therefore, it is preferable that the lower wall 116*e* or the upstream side wall 116*g* is inclined. Additionally, a thickness of the lower wall 116*e* or a thickness of the upstream side wall 116*g* may be gradually increased toward the downstream side in the flow direction of the cooling air and a wall surface of the lower air duct 116 may be inclined inward to gradually reduce the cross-sectional area toward the downstream side in the flow direction of the cooling air.

Additionally, as described above, the exhaust port that the air flowing inside from the image forming apparatus 1000 is provided on the rear side of the housing of the image forming apparatus 1000 (on the downstream side in the flow direction of the cooling air). Therefore, part of the cooling air blown out from the plurality of lower conveyance passage blowout ports 41 flows to the rear side of the image forming apparatus 1000 in the direction indicated by arrow H1 in FIG. 22. Consequently, the cooling air is brought into contact with a portion not facing any of the plurality of lower conveyance passage blowout ports 41 in the sheet width direction. Consequently, the lower surface of the sheet is uniformly cooled in the width direction.

Next, a description is given of a conveyance cooling unit of a variation of the present embodiment of this disclosure.

Figure 23:
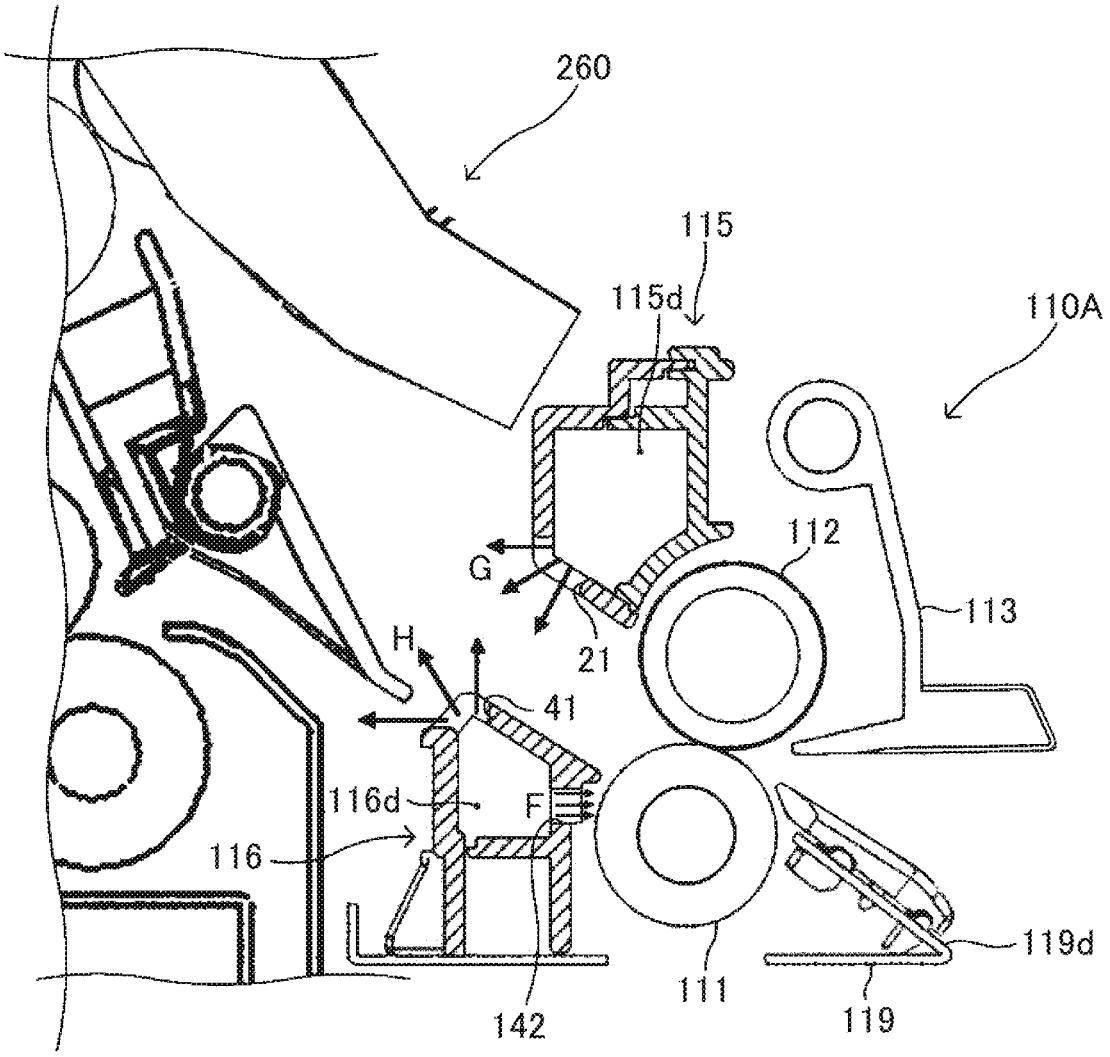
FIG. 23 is a transverse cross-sectional view illustrating a conveyance cooling unit of a variation.
Figure 24A:
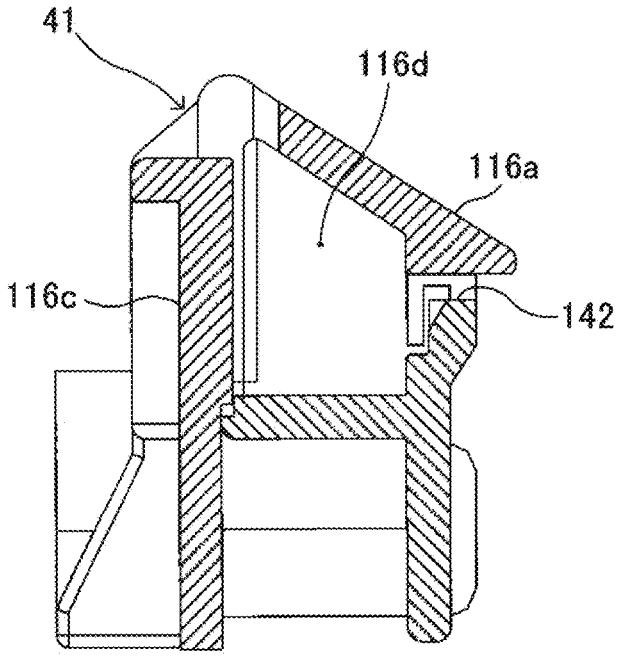
FIGS. 24A and 24B are cross-sectional views of a lower air duct in the conveyance cooling unit of the variation.
Figure 24B:
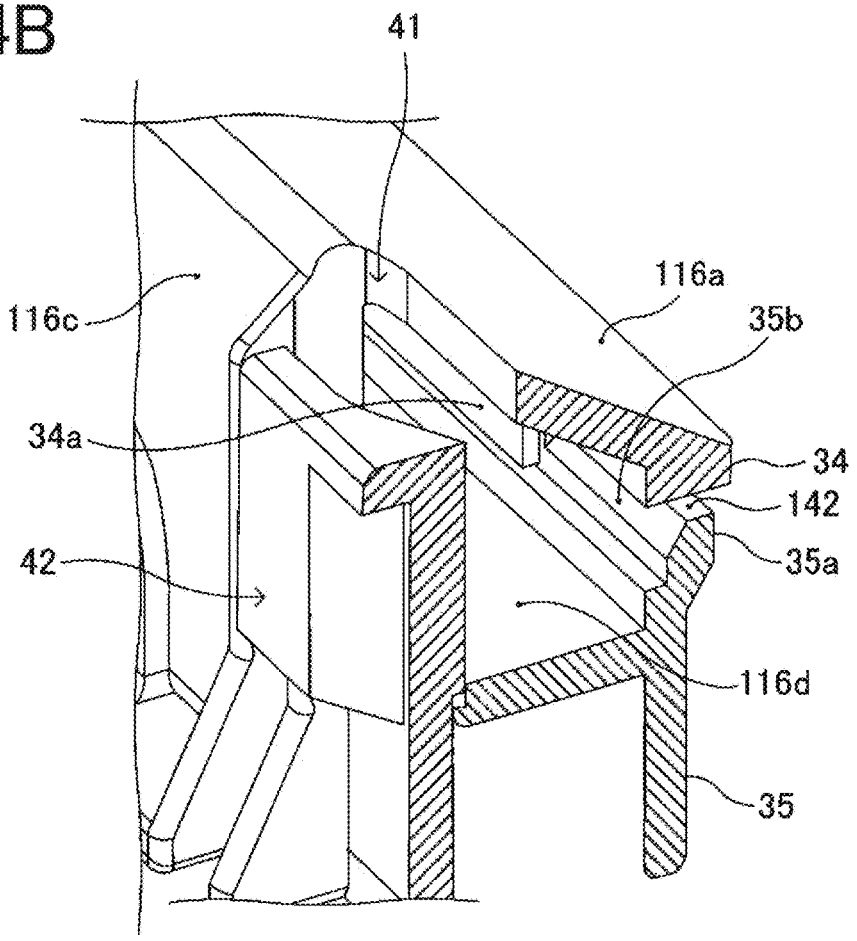

FIG. 23 is a transverse cross-sectional view illustrating a conveyance cooling unit 110A of a variation. FIGS. 24A and 24B are cross-sectional views of the lower air duct 116 in the conveyance cooling unit 110A of the variation of FIG. 23.

As illustrated in FIG. 23, in this variation, the lower air duct 116 includes a roller blowout port 142 that blows out the cooling air toward the drive roller 111.

As illustrated in FIG. 24B, the groove 34*a* of the first lower member 34 is provided with a cut portion at a predetermined interval in the duct longitudinal direction to form the roller blowout port 142. Additionally, a portion on the lower air blowing passage 116*d* side of the protrusion 35*a* of the second lower member 35, in which the portion corresponds to the roller blowout port 142, includes an inclined surface 35*b* inclined so as to be located gradually outward toward the upper side. According to this configuration, pressure loss of the cooling air is restrained or prevented.

In this variation, the cooling air is conveyed toward the drive roller 111 at a short distance directly from the roller blowout port 142 provided in the lower air duct 116, thereby achieving an effect of constantly cooling the drive roller 111. Consequently, the drive roller 111 is cooled at the same time when the temperature of the drive roller 111 rises due to a sheet passage. Thus, the temperature of the drive roller 111 is restrained from rising. Additionally, heat of the driven roller 112 is moved to the drive roller 111, and the temperature of the driven roller 112 is restrained from rising. Consequently, an increase in temperature of the roller pair, that is, the drive roller 111 and the driven roller 112, is prevented. Accordingly, the toner is prevented from adhering to the driven roller 112, the drive roller 111, or both, and a conveyed sheet is prevented from being wound around the rollers such as the drive roller 111 and the driven roller 112.

Furthermore, the upper air duct 115 may have the above-described configuration illustrated in FIG. 4 and the lower air duct 116 may have the configuration illustrated in FIG. 23, so as to cool the driven roller 112 and the drive roller 111 with the cooling air. With this configuration, an increase in temperature of the roller pair (i.e., the drive roller 111 and the driven roller 112) is prevented.

The configurations according to the above-descried embodiments are not limited thereto. This disclosure can achieve the following aspects effectively.

Aspect 1

In Aspect 1, a cooling device (for example, the conveyance cooling unit 110) includes a sheet conveying roller (for example, the driven roller 112) and a duct (for example, the upper air duct 115). The sheet conveying roller is configured to convey a sheet (for example, the sheet P) in the sheet conveyance direction. The duct is configured to convey air to a sheet conveyance passage (for example, the sheet ejection passage 206). The duct includes a first blowing port (for example, the upper first opening 21*a*) configured to blow air toward the sheet conveyance passage, and a second blowing port (for example, the plurality of roller blowout ports 22) configured to blow air toward the sheet conveying roller.

According to this configuration, the sheet conveyed along the sheet conveyance passage is cooled by the air blown from the first blowing port, and the sheet conveying roller is cooled by the air blown from the second blowing port. Consequently, an increase in temperature of the sheet and an increase in temperature of the conveyance roller are restrained.

Aspect 2

In Aspect 1, the duct (for example, the upper air duct 115) includes a sheet opposing face (for example, the upper sheet guide face 115*b*) and a downstream wall (for example, the downstream side wall 1150. The sheet opposing face includes the first blowing port (for example, the upper first opening 21*a*) and extending along the sheet conveyance passage (for example, the sheet ejection passage 206). The downstream side wall extends from a downstream end of the sheet opposing face in the sheet conveyance direction, toward a direction away from the sheet conveyance passage. The downstream side wall has a third blowing port (for example, the upper second opening 21*b*).

According to this configuration, as described in the above embodiments, the cooling air is blown to a broad range of a sheet, and the sheet is excellently cooled as described in the embodiments. Furthermore, members (such as a guide plate and a roller of the sheet ejection unit 260) disposed on the downstream side in the sheet conveyance direction is cooled by the cooling air blown out from the third blowing port such as the upper second opening 21*b*.

Aspect 3

In Aspect 2, the first blowing port (for example, the upper first opening 21*a*) and the third blowing port (for example, the upper second opening 21*b*) of the duct (for example, the upper air duct 115) are coupled to each other.

According to this configuration, as described in the above embodiment, the first blowing port such as the upper first opening 21*a* and the third blowing port such as the upper second opening 21*b* are coupled to form the upper conveyance passage blowout port 21. As a result, a downstream end of the upper conveyance passage blowout port 21 is provided at a position more distant from the sheet conveyance passage such as the sheet ejection passage 206, than the sheet opposing face such as the upper sheet guide face 115*b* is. Consequently, a sheet is prevented from being caught at the downstream end of the first blowing port in the sheet conveyance direction, and occurrence of edge folding error or occurrence of conveyance failure is prevented.

Aspect 4

In any one of Aspects 1 to 3, wherein the duct (for example, the upper air duct 115) is rotatably supported between an opposing position at which the duct faces the sheet conveyance passage (for example, the sheet ejection passage 206) and a retracted position at which the duct is retracted from the opposing position.

According to this configuration, as described in the above embodiments, when a jammed sheet is to be removed from the sheet conveyance passage such as the sheet ejection passage 206, the duct such as the upper air duct 115 is rotated from the opposing position to the retracted position in accordance with movement of the jammed sheet, and the duct is prevented from hindering the removal of the jammed sheet. Consequently, the jammed sheet is easily removed.

Aspect 5

In Aspect 4, the cooling device (for example, the conveyance cooling unit 110) further includes a biasing member (for example, the front torsion spring 118*a* and the rear torsion spring 118*b*) configured to bias the duct (for example, the upper air duct 115) toward the opposing position.

According to this configuration, as described in the above embodiment, when a sheet (for example, the sheet P) contacts the duct such as the upper air duct 115 during sheet passage, the duct is prevented from unsteadily being moved to the retracted position by sheet conveyance force.

Aspect 6

In any one of Aspects 1 to 5, the cooling device (for example, the conveyance cooling unit 110) further includes a plurality of first blowing ports (for example, the upper first openings 21*a*, technically, of the plurality of upper conveyance passage blowout ports 21) and a plurality of second blowing ports (for example, the plurality of roller blowout ports 22). The plurality of first blowing ports including the first blowing port (for example, the upper first opening 21*a*) is spaced apart at intervals in an air flowing direction in the duct (for example, the upper air duct 115). The plurality of second blowing ports including the second blowing port (for example, the plurality of roller blowout ports 22) is spaced apart at intervals in the air flowing direction in the duct. The duct includes an air flow passage (for example, the upper air blowing passage 115*d* of the duct) configured to decrease in cross sectional area from an upstream side toward a downstream side in the air flowing direction.

According to this configuration, as described in the above embodiments, the air is blown out from the first blowing and the second blowing port, which are located on the upstream side in the air flow direction, thereby decreasing a flow rate of the air inside the air flow passage such as the upper air blowing passage 115*d*. However, since the cross-sectional area of the air flow passage such as the upper air blowing passage 115*d* is reduced in accordance with the decrease in the flow rate of the air inside the air flow passage, a decrease in a flow speed inside the air flow passage is restrained (in an equation of the flow rate/the cross-sectional area of the duct=the flow speed). Consequently, the flow rate per unit time of the first blowing port and the second blowing port, which are located on the downstream side of the air flow direction is restrained from decreasing. Due to this fact, the air is blown out evenly from the first blowing port and the second blowing port without changing shapes of the first blowing port and the second blowing port in the air flow direction. As a result, the sheet (for example, the sheet P) and the sheet conveying roller (for example, the driven roller 112) are evenly cooled in a sheet width direction and an axial direction of the sheet conveying roller.

Aspect 7

In any one of Aspects 1 to 6, the first blowing port (for example, the upper first opening 21*a*) includes an edge (for example, the edges 21*c*1 and 21*c*2) extending in the sheet conveyance direction of the first blowing port, to widen the first blowing port toward a downstream side in the sheet conveyance direction.

According to this configuration, as described in the above embodiments, a sheet (for example, the sheet P) is restrained from being caught at the edges such as the edges 21*c*1 and 21*c*2 extending in the sheet conveyance direction of the first blowing port such as the upper first opening 21*a*. Consequently, occurrence of sheet edge folding error is prevented. Furthermore, since the edge such as the edges 21*c*1 and 21*c*2 is inclined, an image on the sheet is hardly caught at the edges when the image on the sheet contacts on the edges, and streaks is prevented from being formed on the image.

Aspect 8

In any one of Aspects 1 to 7, the second blowing port (for example, the plurality of roller blowout ports 22) is disposed facing the sheet conveying roller (for example, the driven roller 112).

According to this configuration, as described in the above embodiments, the air is blown directly to the sheet conveying roller such as the driven roller 112 from the second blowing port such as the plurality of roller blowout ports 22, and the sheet conveying roller is excellently cooled by the air.

Aspect 9

In any one of Aspects 1 to 8, the cooling device (for example, the conveyance cooling unit 110) further includes a second duct (for example, the lower air duct 116) disposed on an opposite side to the duct (for example, the upper air duct 115) across the sheet conveyance passage (for example, the sheet ejection passage 206) and includes a fourth blowing port (for example, the lower first opening 41*a*) configured to blow air from the opposite side to the duct across the sheet conveyance passage, toward the sheet conveyance passage.

According to this configuration, as described in the above embodiments, both faces of the sheet (for example, the sheet P) are cooled by the air, and the sheet is excellently cooled.

Aspect 10

In Aspect 9, the second duct (for example, the lower air duct 116) includes a sheet opposing face (for example, the lower sheet guide face 116*a*) and a fifth blowing port (for example, the lower second opening 41*b*). The sheet opposing face includes the fourth blowing port (for example, the lower first opening 41*a*) and extends along the sheet conveyance passage (for example, the sheet ejection passage 206). The fifth blowing port is configured to blow air toward a downstream side in the sheet conveyance direction.

According to this configuration, as described in the above embodiments, the cooling air is blown to a broad range of a sheet (for example, the sheet P), and the sheet is excellently cooled as described in the embodiment.

Aspect 11

In Aspect 10, the fourth blowing port (for example, the lower first opening 41*a*) and the fifth blowing port (for example, lower second opening 41*b*) of the second duct (for example, the lower air duct 116) are coupled to each other. A downstream end of the fifth blowing port in the sheet conveyance direction is retracted farther than the downstream end of the sheet opposing face (for example, the lower sheet guide face 116*a*), from the sheet conveyance passage (for example, the sheet ejection passage 206).

According to this configuration, as described in the above embodiments, the fourth blowing port such as the lower first opening 41*a* and the fifth blowing port such as the lower second opening 41*b* are connected to form each of the plurality of lower conveyance passage blowout ports 41. Further, the downstream end of the fifth blowing port in the sheet conveyance direction is provided at a position more retracted than the most sheet ejection passage side (i.e., the downstream end) of the sheet opposing face such as the lower sheet guide face 116*a*, from the sheet conveyance passage. Consequently, a sheet is prevented from being caught at the downstream end of the plurality of lower conveyance passage blowout ports 41, and occurrence of edge folding error or occurrence of conveyance failure is prevented.

Aspect 12

In Aspect 10 or Aspect 11, the second duct (for example, the lower air duct 116) is configured to blow air in an axial direction of the sheet conveying roller (for example, the driven roller 112). The second duct includes an air flow passage (for example, the lower air blowing passage 116*d*), and an air discharging portion (for example, the plurality of exhaust devices 42) disposed projecting on a downstream side in the sheet conveyance direction to the air flow passage. The air discharging portion is configured to discharge air in the second duct through the fourth blowing port (for example, the lower first opening 41*a*) and the fifth blowing port (for example, lower second opening 41*b*). The air discharging portion has a sloped portion (for example, the first inclined portion 42*a* and the second inclined portion 42*b*) having a slope from an upstream side to the downstream side in an air flowing direction in the second duct.

According to this configuration, as described in the above embodiments, pressure loss of the air that flows to the air discharging portion is restrained. Consequently, the decrease in the flow speed of the air blown out from the fourth blowout port such as the lower first opening 41*a* and the fifth blowout port such as the lower second opening 41*b* is prevented.

Aspect 13

In any one of Aspects 9 to 12, the cooling device (for example, the conveyance cooling unit 110) further includes a plurality of fourth blowing ports (for example, the lower first openings 41*a*) including the fourth blowing port (for example, the lower first opening 41*a*). The plurality of fourth blowing ports are spaced apart at intervals in an air flowing direction in the second duct (for example, the lower air duct 116). The second duct includes an air flow passage (for example, the lower air blowing passage 116*d*) configured to decrease in cross sectional area from an upstream side toward a downstream side in the air flowing direction.

According to this configuration, as described in the above embodiment, when the air is blown out from the plurality of fourth blowing ports such as the lower first openings 41*a* located on the upstream side in the air flow direction, thereby decreasing the flow rate of the air inside the air blowing passage such as the lower air blowing passage 116*d*. However, since the cross-sectional area of the air blowing passage is reduced in accordance with the decrease in the flow rate, the flow speed inside the air blowing passage is restrained from decreasing (i.e., the equation of Flow Rate/Cross-sectional Area of Duct=Flow Speed). Consequently, the decrease in the flow rate per unit time at a fourth blowout port located on the downstream side in the air flow direction is prevented. According to this configuration, the air is blown out evenly from the respective blowout ports without changing shapes of the respective blowout ports in the air flow direction. As a result, the sheet is cooled uniformly in the sheet width direction.

Aspect 14

In Aspect 14, an image forming apparatus (for example, the image forming apparatus 1000) includes an image forming device (for example, the image forming device 2), a fixing device (for example, the fixing device 106), and the cooling device (for example, the conveyance cooling unit 110). The image forming device is configured to form an image on a sheet (for example, the sheet P). The fixing device is configured to fix the image to the sheet. The cooling device is configured to cool the sheet conveyed from the fixing device.

According to this configuration, the sheet conveyed out from the fixing device and the sheet conveying roller (for example, the driven roller 112) that conveys the sheet from the fixing device.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. A cooling device comprising:

a sheet conveying roller configured to convey a sheet in a sheet conveyance direction; and a duct configured to convey air to a sheet conveyance passage, the duct including, a plurality of first blowing ports spaced apart at intervals in an air flowing direction in the duct, the plurality of first blowing ports configured to blow air toward the sheet conveyance passage, and a plurality of second blowing ports spaced apart at intervals in the air flowing direction in the duct, the plurality of second blowing ports configured to blow air toward the sheet conveying roller, wherein the duct includes an air flow passage configured to decrease in cross sectional area from an upstream side toward a downstream side in the air flowing direction.

2. The cooling device according to claim 1, wherein the duct includes:

a sheet opposing face including at least one of the plurality of first blowing ports and extending along the sheet conveyance passage; and a downstream side wall extending from a downstream end of the sheet opposing face in the sheet conveyance direction, toward a direction away from the sheet conveyance passage, the downstream side wall having a third blowing port.

3. The cooling device according to claim 2, wherein the at least one of the plurality of first blowing ports and the third blowing port of the duct are coupled to each other.

4. The cooling device according to claim 1, wherein the duct is rotatably supported between an opposing position at which the duct faces the sheet conveyance passage and a retracted position at which the duct is retracted from the opposing position.

5. The cooling device according to claim 4, further comprising:

a biasing member configured to bias the duct toward the opposing position.

6. The cooling device according to claim 1, wherein at least one of the plurality of first blowing ports includes an edge extending in the sheet conveyance direction of the at least one of the plurality of first blowing ports, to widen the at least one of the plurality of first blowing ports toward a downstream side in the sheet conveyance direction.

7. The cooling device according to claim 1, wherein at least one of the plurality of second blowing ports is disposed facing the sheet conveying roller.

8. The cooling device according to claim 1, further comprising:

a second duct on an opposite side to the duct across the sheet conveyance passage and including a fourth blowing port configured to blow air from the opposite side to the duct across the sheet conveyance passage, toward the sheet conveyance passage.

9. The cooling device according to claim 8, wherein the second duct includes a sheet opposing face including the fourth blowing port and extending along the sheet conveyance passage; and a fifth blowing port configured to blow air from a downstream end of the sheet opposing face toward a downstream side in the sheet conveyance direction.

10. The cooling device according to claim 9, wherein the fourth blowing port and the fifth blowing port of the second duct are coupled to each other, and wherein a downstream end of the fifth blowing port in the sheet conveyance direction is retracted farther than the downstream end of the sheet opposing face, from the sheet conveyance passage.

11. The cooling device according to claim 9, wherein the second duct is configured to blow air in an axial direction of the sheet conveying roller, wherein the second duct includes an air flow passage; and an air discharging portion disposed projecting on a downstream side in the sheet conveyance direction to the air flow passage, the air discharging portion configured to discharge air in the second duct through the fourth blowing port and the fifth blowing port, and wherein the air discharging portion has a sloped portion having a slope from an upstream side to the downstream side in an air flowing direction in the second duct.

12. The cooling device according to claim 8, further comprising:

a plurality of fourth blowing ports, including the fourth blowing port, spaced apart at intervals in an air flowing direction in the second duct, wherein the second duct includes an air flow passage configured to decrease in cross sectional area from an upstream side toward a downstream side in the air flowing direction.

13. An image forming apparatus comprising:

an image forming device configured to form an image on a sheet;

a fixing device configured to fix the image to the sheet; and the cooling device according to claim 1, configured to cool the sheet conveyed from the fixing device.

14. A cooling device comprising:

a sheet conveying roller configured to convey a sheet in a sheet conveyance direction; and a duct configured to convey air to a sheet conveyance passage, the duct including, a first blowing port configured to blow air toward the sheet conveyance passage, a second blowing port configured to blow air toward the sheet conveying roller, a sheet opposing face including the first blowing port and extending along the sheet conveyance passage, and a downstream side wall extending from a downstream end of the sheet opposing face in the sheet conveyance direction, toward a direction away from the sheet conveyance passage, the downstream side wall having a third blowing port.

15. The cooling device according to claim 14, wherein the first blowing port and the third blowing port of the duct are coupled to each other.

16. A cooling device comprising:

a sheet conveying roller configured to convey a sheet in a sheet conveyance direction;

a first duct configured to convey air to a sheet conveyance passage, the first duct including a first blowing port configured to blow air toward the sheet conveyance passage and a second blowing port configured to blow air toward the sheet conveying roller; and a second duct on an opposite side to the first duct across the sheet conveyance passage, the second duct including a third blowing port configured to blow air from the opposite side toward the sheet conveyance passage.

17. The cooling device according to claim 16, wherein the second duct includes a sheet opposing face including the third blowing port and extending along the sheet conveyance passage; and a fourth blowing port configured to blow air from a downstream end of the sheet opposing face toward a downstream side in the sheet conveyance direction.

18. The cooling device according to claim 17, wherein the third blowing port and the fourth blowing port of the second duct are coupled to each other, and wherein a downstream end of the fourth blowing port in the sheet conveyance direction is retracted farther than the downstream end of the sheet opposing face, from the sheet conveyance passage.

19. The cooling device according to claim 17, wherein the second duct is configured to blow air in an axial direction of the sheet conveying roller, wherein the second duct includes an air flow passage; and an air discharging portion disposed projecting on a downstream side in the sheet conveyance direction to the air flow passage, the air discharging portion configured to discharge air in the second duct through the third blowing port and the fourth blowing port, and wherein the air discharging portion has a sloped portion having a slope from an upstream side to the downstream side in an air flowing direction in the second duct.

20. The cooling device according to claim 16, wherein the third blowing port is one of a plurality of third blowing ports spaced apart at intervals in an air flowing direction in the second duct, and wherein the second duct includes an air flow passage configured to decrease in cross sectional area from an upstream side toward a downstream side in the air flowing direction.

* * * * *